US010268132B2

(12) United States Patent
Fujino et al.

(10) Patent No.: US 10,268,132 B2
(45) Date of Patent: Apr. 23, 2019

(54) CHARGING ROLLER, CARTRIDGE, IMAGE FORMING APPARATUS AND MANUFACTURING METHOD OF THE CHARGING ROLLER

(71) Applicant: CANON KABUSHIKI KAISHA, Tokyo (JP)

(72) Inventors: Takeshi Fujino, Abiko (JP); Kota Mori, Abiko (JP); Yuya Nagatomo, Toride (JP); Michihiro Yoshida, Nagareyama (JP); Jiro Kinokuni, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/004,653

(22) Filed: Jun. 11, 2018

(65) Prior Publication Data

US 2018/0364604 A1 Dec. 20, 2018

(30) Foreign Application Priority Data

Jun. 15, 2017 (JP) ..... 2017-118135
Apr. 9, 2018 (JP) ..... 2018-075088

(51) Int. Cl.
*G03G 15/02* (2006.01)

(52) U.S. Cl.
CPC ... *G03G 15/0233* (2013.01); *G03G 2215/021* (2013.01)

(58) Field of Classification Search
CPC ..... G03G 15/0233; G03G 2215/021
USPC ..... 399/176
See application file for complete search history.

(56) References Cited

U.S. PATENT DOCUMENTS

| | | | |
|---|---|---|---|
| 6,806,009 | B2 | 10/2004 | Tanaka et al. |
| 7,551,878 | B2 | 6/2009 | Ogaki et al. |
| 7,556,901 | B2 | 7/2009 | Anezaki et al. |
| 7,622,238 | B2 | 11/2009 | Uematsu et al. |
| 7,718,331 | B2 | 5/2010 | Uematsu et al. |
| 7,749,667 | B2 | 7/2010 | Kawahara et al. |
| 9,280,079 | B1 | 3/2016 | Hoshio et al. |
| 9,703,226 | B2 | 7/2017 | Kuroda |

(Continued)

FOREIGN PATENT DOCUMENTS

| | | |
|---|---|---|
| JP | 3944072 B2 | 7/2007 |
| JP | 4047057 B2 | 2/2008 |

(Continued)

*Primary Examiner* — Robert Beatty
(74) *Attorney, Agent, or Firm* — Venable LLP

(57) ABSTRACT

A charging roller includes a surface layer containing first and second surface particles and satisfying the following:

$$6.0\ (\mu m) \leq Rz \leq 18.8\ (\mu m), \quad \text{i}$$

where Rz is a ten-point average roughness (μm) of a charging roller surface, $$7\ (\mu m) \leq d \leq 20\ (\mu m), \quad \text{ii}$$

where d is a thickness (μm) of the surface layer, $$9.8\ (\mu m) \leq D1 \leq 15.8\ (\mu m) \text{ and } 2.8\ (\mu m) \leq D2 \leq 5.2\ (\mu m), \quad \text{iii}$$

where D1 and D2 are average particle size (μm) of the first surface particles, and the second surface particles, respectively, $$3.0 \leq D1/D2 \leq 5.6, \text{ and} \quad \text{iv}$$

$$0.10 \leq M1/(M1+M2) \leq 0.32, \quad \text{v}$$

where M1 is a total weight (mg) of the first surface particles per unit area of the charging roller surface, and M2 is a total weight (mg) of the second surface particles per unit area of the charging roller surface.

18 Claims, 4 Drawing Sheets

(56) References Cited

U.S. PATENT DOCUMENTS

| | | | | |
|---|---|---|---|---|
| 2008/0096123 | A1 | 4/2008 | Shimada et al. | |
| 2009/0170023 | A1 | 7/2009 | Shimada et al. | |
| 2010/0142998 | A1* | 6/2010 | Furukawa | G03G 15/0233 399/176 |
| 2011/0002711 | A1* | 1/2011 | Wada | G03G 15/0233 399/176 |
| 2013/0295330 | A1* | 11/2013 | Kodama | G03G 15/02 428/147 |
| 2015/0003874 | A1* | 1/2015 | Aoyama | G03G 15/0233 399/176 |
| 2015/0087489 | A1* | 3/2015 | Sato | G03G 5/087 492/18 |
| 2016/0266511 | A1* | 9/2016 | Kuroda | G03G 15/0233 |

FOREIGN PATENT DOCUMENTS

| | | | |
|---|---|---|---|
| JP | 4101278 | B2 | 6/2008 |
| JP | 2015-121769 | A | 7/2015 |
| JP | 2016-177184 | A | 10/2016 |

* cited by examiner (a)

(b)

CHARGING ROLLER, CARTRIDGE, IMAGE FORMING APPARATUS AND MANUFACTURING METHOD OF THE CHARGING ROLLER

FIELD OF THE INVENTION AND RELATED ART

The present invention relates to an image forming apparatus, such as a copying machine, a printer or a facsimile machine, of an electrophotographic type, or an electrostatic recording type, and relates to a charging roller and a cartridge which are for use with the image forming apparatus, and a manufacturing method of the charging roller.

Conventionally, for example, in the image forming apparatus of the electrophotographic type, as a type of electrically charging a photosensitive member (electrophotographic photosensitive member) as an image bearing member, a contact charging type in which the photosensitive member is charged under application of a voltage to a charging member contacted to the photosensitive member. As the charging member, a roller-shaped charging roller is used in many cases. The charging roller has, for example, a constitution in which an electroconductive elastic layer is provided on an outer peripheral surface of an electroconductive supporting member and on a surface of the electroconductive supporting member, an electroconductive surface layer is coated. In the contact charging type, the surface of the photosensitive member is charged by electric discharge (Paschen electric discharge) generating in a small gap between the photosensitive member and the charging member. The contact charging type includes an "AC charging type" in which a voltage in the form of a DC voltage biased with an AC voltage is applied to the charging member and a "DC charging type" in which only a DC voltage is applied to the charging member. The DC charging type does not require an AC voltage source and therefore is advantageous in downsizing, simplification of a constitution and cost reduction. Further, in the DC charging type, a discharge amount is small compared with the AC charging type, so that abrasion (wearing) of the surface of the photosensitive member is suppressed, and therefore, the DC charging type is advantageous in lifetime extension. On the other hand, in the DC charging type, a conveying effect of a photosensitive member surface potential by an AC voltage obtained in the AC charging type is not obtained, and therefore, there is a tendency that abnormality of a surface shape of the charging member and deposition of a foreign matter on a surface of the charging member are liable to appear as image defects. In the case of the DC charging type, compared with the AC charging type, the abnormality of the surface shape of the charging member is required to be relatively decreased or reduced.

On the other hand, when the surface of the charging member is excessively smooth, contaminants (such as toner slipped through a cleaning member and an external additive liberated from the toner depositing on the photosensitive member are liable to deposit on the surface of the charging member. Further, in some cases, at a position corresponding to a portion where the contaminants deposit on the surface of the charging member, stripe image density non-uniformity (image stripe) generates along a direction substantially parallel to a surface movement direction of the photosensitive member) or the like. In order to suppress the deposition of the contaminants on the charging member, a decrease in contact area between the photosensitive member and the charging member in such a manner that a surface roughness of the charging member is increased is effective. Japanese Patent No. 4047057 discloses a charging member having the following constitution for the purpose of ensuring charging uniformity by controlling a surface shape through suppression of generation of creases on an outermost layer of the charging member. That is, the charging member has a surface roughness (Rz) of more than 10 μm and less than 25 μm, and in the outermost layer thereof, two kinds of particles different in particle size consisting of positions of 15-25 μm in average particle size A and small particles of less than 7 μm in average particle size B are dispersed. Further, a ratio of the average particle size A of the large particles to the average particle size B of the small particles (i.e., A/B) is made larger than 2 and smaller than 12. Further, a mixing ratio between the large particles and the small particles, i.e., a/(a+b) where a is a mixing amount of the large particles and b is a mixing amount of the small particles, is 0.7 or more and 0.9 or less.

However, as a result of further study on the mixing ratio by the present inventors, in the case where the mixing ratio "a/(a+b)" between the large particles and the small particles is 0.7 or more and 0.9 or less, it turned out that although the image defects such as a black spot was suppressed, a developing fog generated in some instances. The black spot is a phenomenon that a black-spot-like image density non-uniformity generates due to a locally insufficient charge potential on the surface of the photosensitive member. The developing fog is a phenomenon that the toner deposits on a non-image portion in a relatively broad range due to an insufficient charge potential of the photosensitive member.

On the other hand, in the case where the mixing ratio "a/(a+b)" is excessively low, it turned out that a contact area between the photosensitive drum and the charging roller increased due to an excessively small number of the large particles and the contaminants were liable to deposit on the charging roller and worsened a degree of the image stripe.

SUMMARY OF THE INVENTION

According to an aspect of the present invention, there is provided a charging roller for electrically charging a photosensitive member in contact with the photosensitive member, the charging roller comprising: an outermost surface layer including an electroconductive resin material, first surface particles configured to form first projections on a surface of the charging roller, and second surface particles configured to form second projections on the surface of the charging roller, wherein the outermost surface layer satisfies the following conditions i) to v): i) 6.0 (μm)≤Rz≤18.8 (μm), where Rz is a ten-point average roughness (μm) of the surface of the charging roller, ii) 7 (μm)≤d≤20 (μm), where d is a thickness (μm) of the outermost surface layer, iii) 9.8 (μm)≤D1≤15.8 (μm) and 2.8 (μm)≤D2≤5.2 (μm), where D1 is an average particle size (μm) of the first surface particles, and D2 is an average particle size (μm) of the second surface particles, iv) 3.0≤D1/D2≤5.6, and v) 0.10≤M1/(M1+M2) ≤0.32, where M1 is a total weight (mg) of the first surface particles per unit area of the surface of the charging roller, and M2 is a total weight (mg) of the second surface particles per unit area of the surface of the charging roller.

According to another aspect of the present invention, there is provided a cartridge detachably mountable to a main assembly of an image forming apparatus, the cartridge comprising: a photosensitive member; a charging roller configured to electrically charge the photosensitive member in contact with the photosensitive member; an outermost surface layer including an electroconductive resin material, first surface particles configured to form first projections on a surface of the charging roller, and second surface particles configured to form second projections on the surface of the charging roller, wherein the outermost surface layer satisfies the following conditions i) to v): i) 6.0 (μm)≤Rz≤18.8 (μm), where Rz is a ten-point average roughness (μm) of the surface of the charging roller, ii) 7 (μm)≤d≤20 (μm), where d is a thickness (μm) of the outermost surface layer, iii) 9.8 (μm)≤D1≤15.8 (μm) and 2.8 (μm)≤D2≤5.2 (μm), where D1 is an average particle size (μm) of the first surface particles, and D2 is an average particle size (μm) of the second surface particles, iv) 3.0≤D1/D2≤5.6, and v) 0.10≤M1/(M1+M2)≤0.32, where M1 is a total weight (mg) of the first surface particles per unit area of the surface of the charging roller, and M2 is a total weight (mg) of the second surface particles per unit area of the surface of the charging roller.

According to another aspect of the present invention, there is provided an image forming apparatus comprising: a photosensitive member; a charging roller configured to electrically charge a photosensitive member under application of a voltage, wherein the charging roller has an outermost surface layer including an electroconductive resin material, first surface particles configured to form first projections on a surface of the charging roller, and second surface particles configured to form second projections on the surface of the charging roller, wherein the outermost surface layer satisfies the following conditions i) to v): i) 6.0 (μm)≤Rz≤18.8 (μm), where Rz is a ten-point average roughness (μm) of the surface of the charging roller, ii) 7 (μm)≤d≤20 (μm), where d is a thickness (μm) of the outermost surface layer, iii) 9.8 (μm)≤D1≤15.8 (μm) and 2.8 (μm)≤D2≤5.2 (μm), where D1 is an average particle size (μm) of the first surface particles, and D2 is an average particle size (μm) of the second surface particles, iv) 3.0≤D1/D2≤5.6, and v) 0.10≤M1/(M1+M2)≤0.32, where M1 is a total weight (mg) of the first surface particles per unit area of the surface of the charging roller, and M2 is a total weight (mg) of the second surface particles per unit area of the surface of the charging roller; and an image forming portion configured to form a toner image on the photosensitive member charged by the charging roller and then to transfer the toner image onto a recording material.

According to a further aspect of the present invention, there is provided a manufacturing method of a charging roller, including an electroconductive rotation shaft, a base layer formed outside the electroconductive rotation shaft, and a surface layer formed outside the base layer, for electrically charging a photosensitive member in contact with the photosensitive member under application of a voltage, the manufacturing method comprising: a first step of forming the base layer outside the electroconductive rotation shaft; a second step of preparing a surface layer paint by mixing first and second surface particles in a curable resin solution so as to satisfy the following conditions: 9.8 (μm)≤D1≤15.8 (μm), 2.8 (μm)≤D2≤5.2 (μm), 3.0 (μm)≤D1/D2≤5.6, and 0.1≤M1/(M1+M2)≤0.32, where D1 is an average particle size (μm) of the first surface particles, D2 is an average particle size (μm) of the second surface particles, M1 is a total weight (mg) of the first surface particles per unit area of the surface layer paint and M2 is a total weight (mg) of the second surface particles per unit area of the surface layer paint; a third step of forming a coating of the surface layer paint on the base layer; and a fourth step of forming the surface layer by curing the coating, wherein the surface layer formed in the fourth step satisfies the following conditions: 6.0 (μm)≤Rz≤18.8 (μm), and 7 (μm)≤d≤20 (μm), where Rz is a ten-point average roughness (μm) of a surface of the charging roller, and d is a thickness (μm) of the surface layer.

Further features of the present invention will become apparent from the following description of exemplary embodiments with reference to the attached drawings.

Figure 3:
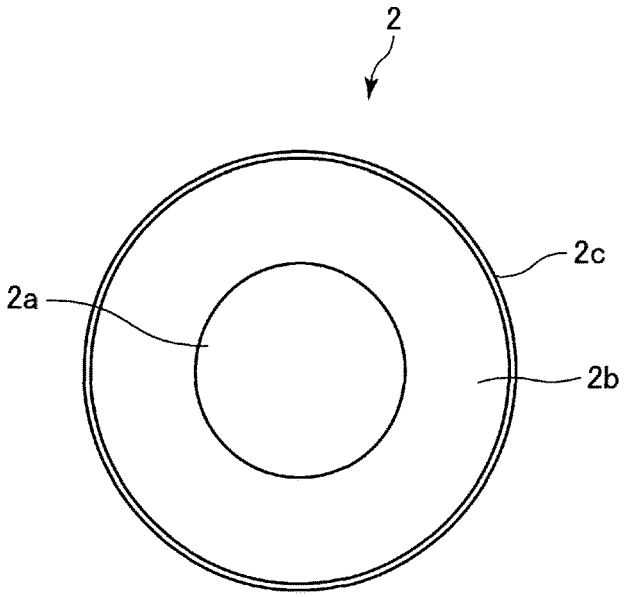
Figure 3:
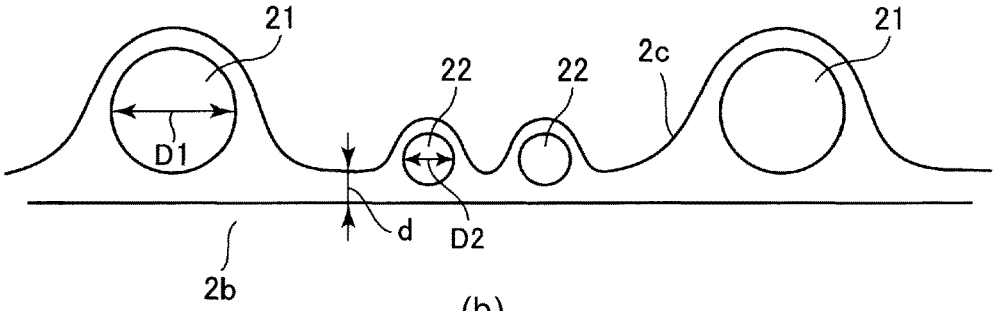

Parts (a) and (b) of FIG. 3 are schematic sectional views of a charging roller and a surface layer of the charging roller, respectively.

Figure 4:
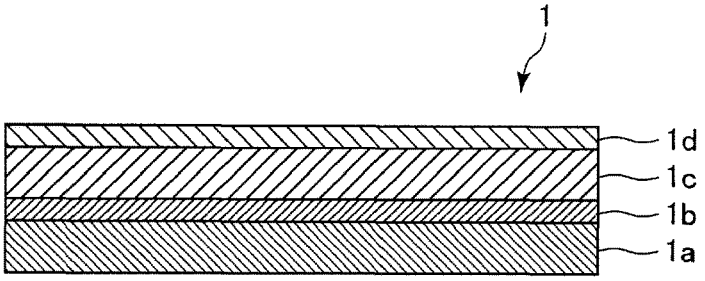

FIG. 4 is a schematic sectional view of a photosensitive drum.

Figure 5:
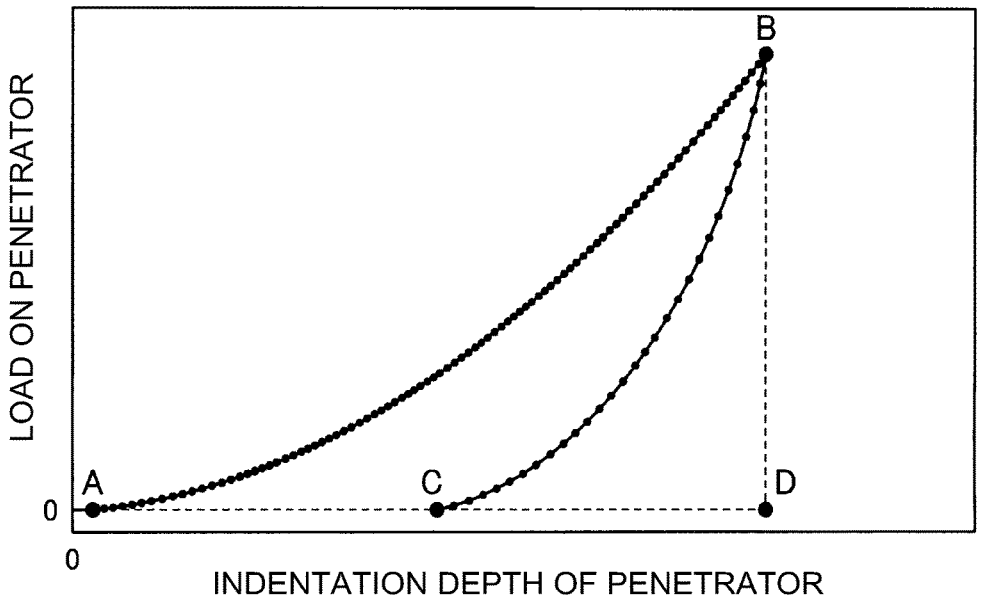

FIG. 5 is a graph for illustrating a measuring method of elastic deformation power.

Figure 6:
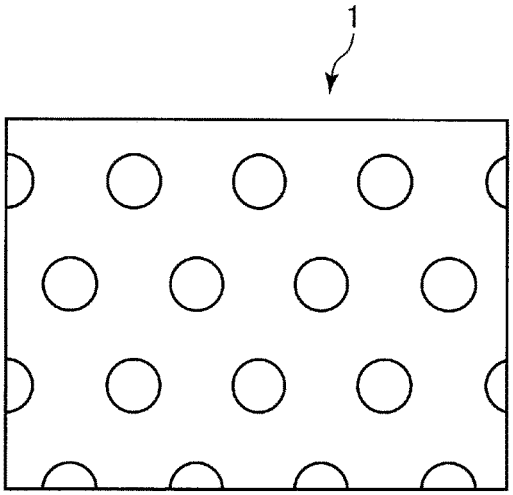

FIG. 6 is a schematic view of recesses formed on a surface of a photosensitive drum.

DESCRIPTION OF THE EMBODIMENTS

An image forming apparatus, a charging member, a cartridge and a charging member manufacturing method, which are in accordance with the present invention will be described with reference to the drawings.

Embodiment 1

1. General Constitution and Operation of Image Forming Apparatus

Figure 1:
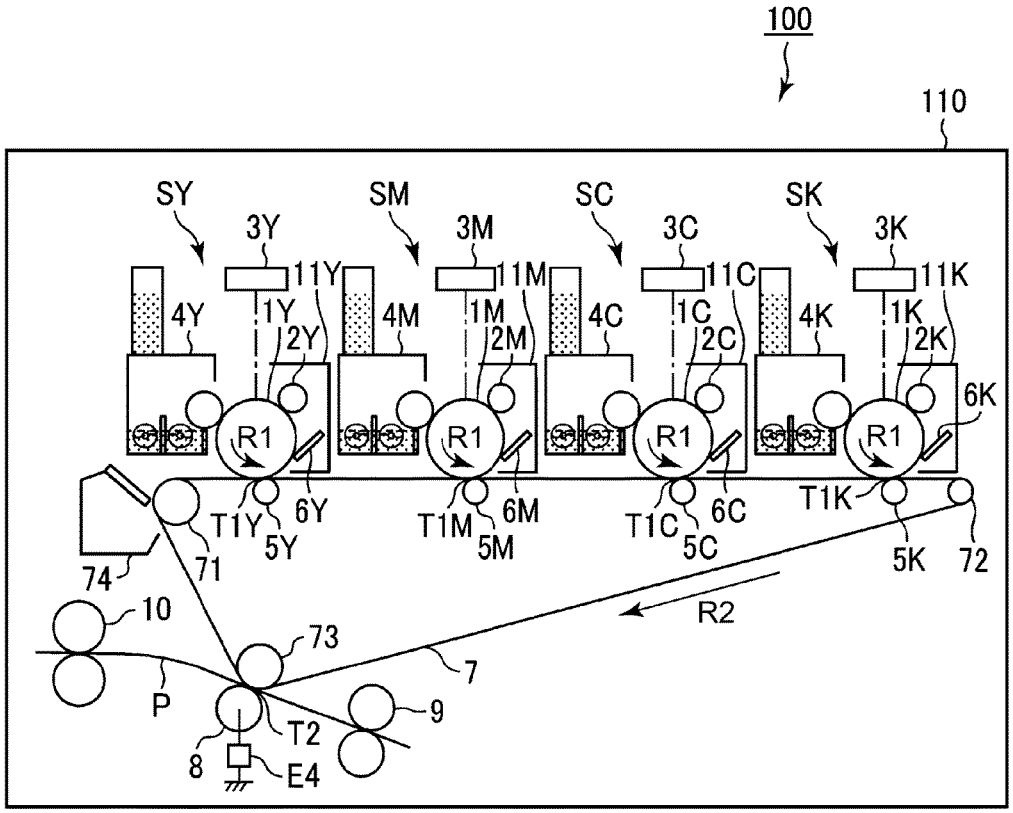
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type (in-line-type) multi-function machine, having functions of a copying machine, a printer and a facsimile apparatus, employing an intermediary transfer type capable of forming a full-color image by using an electrophotographic type. The image forming apparatus 100 of this embodiment employs a contact charging type, which is a DC charging type and is capable of forming an image on an A3-size transfer(-receiving material) to the maximum.

Figure 2:
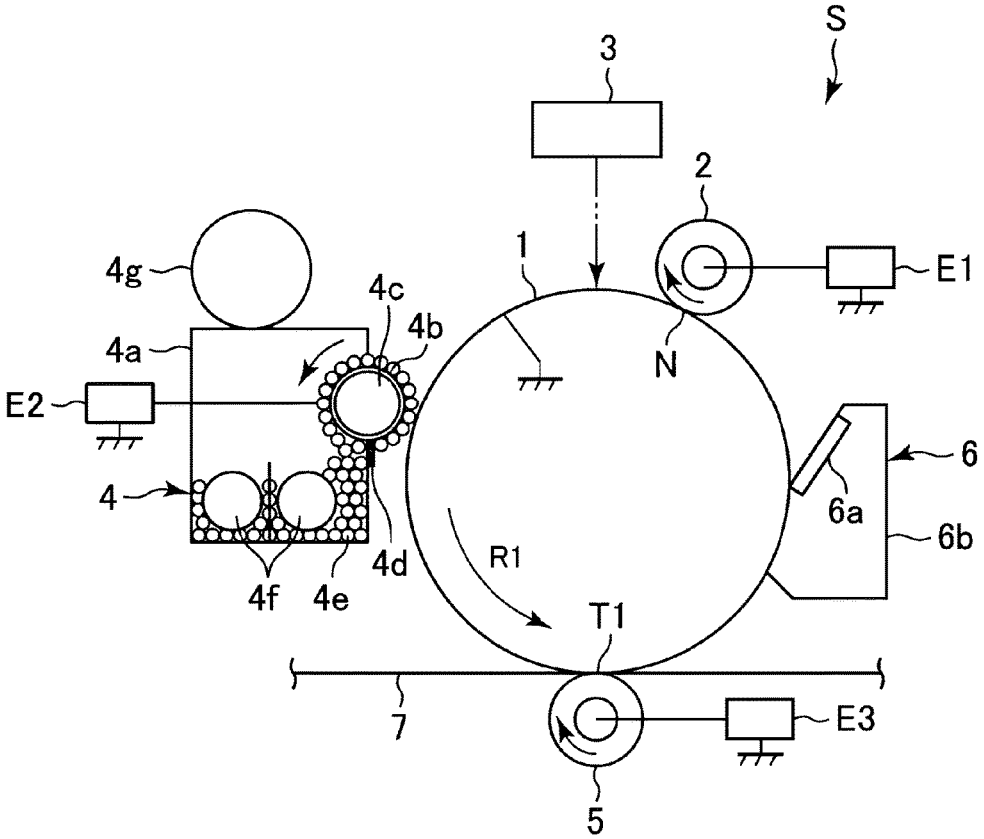
FIG. 2 is a schematic sectional view showing an image forming portion.

The image forming apparatus 100 includes, as a plurality of image forming portions, first to fourth image forming portions SY, SM, SC and SK for forming images of yellow (Y), magenta (M), cyan (C) and black (K), respectively. Incidentally, elements having the same or corresponding functions and constitutions in the respective image forming portions SY, SM, SC and SK are collectively described by omitting suffixes Y, M, C and K for representing elements for associated colors in some cases. FIG. 2 is a schematic sectional view showing a single image forming portion S as a representative. In this embodiment, the image forming portion S is constituted by including a photosensitive drum 1, a charging roller 2, a cleaning member 12, an exposure device 3, a developing device 4, a primary transfer roller 5, a drum cleaning device 6, and the like, which are described later.

The image forming apparatus 100 includes the photosensitive drum 1 which is a rotatable drum-shaped (cylindrical) photosensitive member as an image bearing member.

The photosensitive drum 1 is rotationally driven in an indicated arrow R1 direction at a predetermined peripheral speed (process speed) by a driving motor (not shown) as a driving means. In this embodiment, the photosensitive drum 1 is a negatively chargeable drum-shaped organic photosensitive member and is constituted by forming a photosensitive layer (OPC layer) on a substrate formed of an electroconductive material such as aluminum. A surface of the rotating photosensitive drum 1 is electrically charged uniformly to a predetermined polarity (negative in this embodiment) and a predetermined potential by the charging roller 2 which is a roller-type charging member as a charging means. During a charging step, to the charging roller 2, from a charging voltage source (high-voltage source circuit) E1 as an applying means, a charging voltage (charging bias) consisting only of a DC voltage (DC component) is applied. A charging process of a surface of the photosensitive drum 1 is carried out by electric discharge generating in at least one of minute gaps between the photosensitive drum 1 and the charging roller 2 on upstream and downstream sides of a contact portion N between the photosensitive drum 1 and the charging roller 2 with respect to a rotational direction of the photosensitive drum 1. The charged surface of the photosensitive drum 1 is subjected to scanning exposure to light by the exposure device 3 as an exposure means (electrostatic image forming means), so that an electrostatic image (electrostatic latent image) is formed on the photosensitive drum 1. In this embodiment, the exposure device 3 is a laser beam scanner using a semiconductor laser.

The electrostatic image formed on the photosensitive drum 1 is developed (visualized) with a developer by the developing device 4, so that a toner image is formed on the photosensitive drum 1. In this embodiment, toner charged to the same polarity as a charge polarity (negative polarity in this embodiment) of the photosensitive drum 1 is deposited on an exposed portion, on the photosensitive drum 1, where an absolute value of a potential is lowered by subjecting the surface of the photosensitive drum 1 to the exposure to the laser beam after uniformly charging the surface of the photosensitive drum 1. That is, in this embodiment, a normal toner charge polarity which is the toner charge polarity during development is the negative polarity. In this embodiment, the developing device 4 uses a two-component developer containing toner (non-magnetic toner particles) as the developer and a carrier (magnetic carrier particles). The developing device 4 includes a developing container 4*a* accommodating a developer 4*e* and a developing sleeve 4*b* provided rotatably to the developing container 4*a* so as to be partly exposed toward an outside through an opening of the developer container 4*a* and formed with a non-magnetic hollow cylindrical member. Inside (at a hollow portion of) the developing sleeve 4*b*, a magnet roller 4*c* is provided fixedly to the developing container 4*a*. The developing container 4*a* is provided with a regulating blade 4*d* so as to oppose the developing sleeve 4*b*. In the developing container 4*a*, two stirring members (stirring screws) 4*f* are provided. Into the developing container 4*a*, the toner is appropriately supplied from a toner hopper 4*g*. The developer 4*e* carried on the developing sleeve by a magnetic force of the magnet roller 4*c* is fed to an opposing portion (developing portion) to the photosensitive drum 1 after an amount thereof is regulated by the regulating blade 4*d* with rotation of the developing sleeve 4*b*. The developer on the developing sleeve 4*b* fed to the developing portion erected by the magnetic force of the magnet roller 4*c* and forms a magnetic brush (magnetic chain), so that the developer is contacted to or brought near to the surface of the photosensitive drum 1. During the development, to the developing sleeve 4*b*, from a developing voltage source (high-voltage source circuit) E2, as a developing voltage (developing bias), an oscillating voltage in the form of a DC voltage (DC component) biased with an AC voltage (AC component) is applied. As a result, depending on the electrostatic image on the photosensitive drum 1, the toner is moved from the magnetic brush on the developing sleeve 4*b* onto the photosensitive drum 1, so that the toner image is formed on the photosensitive drum 1.

In this embodiment, a charging amount and an exposure amount are adjusted so that a surface potential (dark portion potential) of the photosensitive drum 1 formed by charging the photosensitive drum 1 by the charging roller 2 is −800 V and so that a surface potential (light portion potential) of the photosensitive drum 1 formed by exposing the photosensitive drum 1 to light by the exposure device 3 is −300 V. Further, in this embodiment, a DC component of a developing voltage is set at −600 V. Further, in this embodiment, a process speed is 250 mm/sec, and a width of an image formable region on the photosensitive drum 1 with respect to a rotational axis direction of the photosensitive drum 1 is 360 mm. Further, in this embodiment, a toner charge amount is about −40 μC/g, and a toner amount on the photosensitive drum 1 at a solid image portion is set at about 0.4 mg/cm$^2$.

An intermediary transfer belt 7 constituted by an endless belt as an intermediary transfer member is provided so as to oppose the respective photosensitive drums 1. The intermediary transfer belt 7 is extended around a driving roller 71, a tension roller 72 and a secondary transfer opposite roller 73 which are used as stretching rollers, and is stretched with a predetermined tension. The intermediary transfer belt 7 is rotated (circulated) by rotationally driving the driving roller 71 in an indicated arrow R2 direction at a peripheral speed (process speed) substantially equal to the peripheral speed of the photosensitive drum 1. In an inner peripheral surface side of the intermediary transfer belt 7, a primary transfer roller 5 which is a roller-type primary transfer member as a primary transfer means is provided corresponding to the associated photosensitive drum 1. The primary transfer roller 5 is pressed (urged) against the intermediary transfer belt 7 toward the photosensitive drum 1, so that a primary transfer portion (primary transfer nip) T1 where the photosensitive drum 1 and the intermediary transfer belt 7 contact each other is formed.

The toner image formed on the photosensitive drum 1 is primary-transferred by the action of the primary transfer roller 5 onto the intermediary transfer belt 7 at the primary transfer portion T1. During a primary transfer step, to the primary transfer roller 5, a primary transfer voltage (primary transfer bias) which is a DC voltage of an opposite polarity to the normal charge polarity of the toner is applied from a primary transfer voltage source (high-voltage source circuit) E3. For example, during full-color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller 8 which is a roller-type secondary transfer member as a secondary transfer means is provided. The secondary transfer roller 8 is pressed (urged) against the intermediary transfer belt 7 toward the secondary transfer opposite roller 73 and forms a secondary transfer portion (secondary transfer nip) T2 where the intermediary transfer belt 7 and the secondary transfer roller 8 are in contact with each other. The toner images formed on the intermediary transfer belt 7 as described above secondary-transferred by the action of the secondary transfer roller 8 onto a transfer(-receiving) material (sheet, recording material) P, such as a recording sheet, nipped and fed at the secondary transfer portion T2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source (high-voltage source circuit) E4. The transfer material P is fed one by one by a feeding device (not shown) and then is conveyed to a registration roller pair 9, and thereafter, the transfer material P is timed to the toner images on the intermediary transfer belt 7 and then is supplied to the secondary transfer portion T2 by the registration roller pair 9. Further, the transfer material P on which the toner images are transferred is fed to a fixing device 10 and is heated and pressed by the fixing device 10, so that the toner images are fixed (melt-fixed) on the transfer material P. Thereafter, the transfer material P on which the toner images are fixed is discharged (outputted) to an outside of the apparatus main assembly 110 of the image forming apparatus 100.

On the other hand, toner (primary transfer residual toner) remaining on the photosensitive drum 1 during the primary transfer is removed and collected from the surface of the photosensitive drum 1 by a drum cleaning device 6 as a photosensitive member cleaning means. The drum cleaning device 6 includes a cleaning blade 6*a* as a cleaning member and includes a cleaning container 6*b*. The drum cleaning device 6 rubs the surface of the rotating photosensitive drum 1 with the cleaning blade 6*a*. As a result, the primary transfer residual toner on the photosensitive drum 1 is scraped off the surface of the photosensitive drum 1 and is accommodated in the cleaning container 6*b*. Further, on an outer peripheral surface side of the intermediary transfer belt 7, a belt cleaning device 74 as an intermediary transfer member cleaning means is provided at a position opposing the driving roller 71. Toner (secondary transfer residual toner) remaining on the surface of the intermediary transfer belt 7 during a secondary transfer step is removed and collected from the surface of the intermediary transfer belt 7 by the belt cleaning device 74.

In this embodiment, at each of the image forming portions S, the photosensitive drum 1, the charging roller 2 and the drum cleaning device 6 integrally constitute a cartridge (drum cartridge) 11 detachably mountable to the apparatus main assembly 110.

2. Summary of Problem and Means for Solving Problem

Next, the conventional problem will be further described.

As described above, in order to suppress the deposition of the contaminant on the charging member, the decrease in contact area between the photosensitive member and the charging member in the manner that the surface roughness of the charging member is increased is effective. The charging member includes, in general, a core metal, a base layer which is formed on an outer peripheral surface of the core metal and which is adjusted in electric resistance by an electroconductive agent or the like, and a surface layer formed by coating and drying a liquid, in which an electroconductive agent or the like and a resin component are dissolved in a solvent, on the surface of the base layer. As a control method of the surface roughness of the surface layer, a method of dispersing micron-size particles ("surface particles"), a method of forming unevenness (projections and recesses) by polishing, and the like method are used. As described above, Japanese Patent No. 4047057 discloses that the surface particles are dispersed in the surface layer of the charging member. However, as described above, it turned out that in the constitution of Japanese Patent No. 4047057, it turned out that although the image defect such as the black spot was suppressed, the developing fog generated in some instances.

As a result of study by the present inventors, it turned out that there are plural causes of generation of the image defect such as the black spot. One of the causes is a shape of the surface layer of the charging member. That is, a gap length between the surface layer and the photosensitive member at a certain position is largely different from that an another position, even when the same voltage is applied, a discharge start voltage is locally different, and therefore, a difference in surface potential of the photosensitive member generates and has the influence thereof as the image defect on the electrostatic image. As regards such an image defect, it turned out the image defect was improved by suppressing aggregate of the surface particles and drying non-uniformity based on the constitution of Japanese Patent No. 4047057. Another cause is the surface particles themselves. Typically, the surface particles dispersed in the surface layer of the charging member are elastic material particles formed of an elastic material which is not readily abraded by friction between the charging member and the photosensitive member. As the material of the surface particles, a styrene-acryl resin material, an urethane-acryl resin material, an urethane resin material, a nylon resin material, composite materials of these resin materials, and the like can be used. These resin materials are high in electric resistance (typically, are insulative), and therefore, a current does not readily flow through the surface particles themselves, so that the Paschen electric discharge generates principally at an electroconductive portion of the surface layer where there are no surface particles. That is, with larger surface particles, a portion where a potential is not readily microscopically provided on the photosensitive member surface exists in a larger amount. Further, according to study by the present inventors, it turned out that when the surface particles are increased in size, the developing fog generates, and when the surface particles are further increased in size, the image defect such as the black spot generates.

According to study by the present inventors, in the case where the particle size (diameter) of the surface particles is 50 μm or more, it turned out that the surface particles are liable to be observed as the image defect such as the black spot. Further, in the case where the particle size of the surface particles is approximately 25 μm, turned out that the surface particles are not readily observed as the image defect but are liable to be observed as the developing fog. Further, in the case where the particle size of the surface particles is 15 μm or less, it turned out that the surface particles are not readily observed as the developing fog. This would be considered because a resolution of human eyes falls within a range of 600-1200 dpi in general, and thus a limit of visual recognition(identification) of dots is about 20-40 μm. That is, there is a possibility that the dots of 50 μm or more are recognized as the image defect, and the dots of about 20-40 μm are not recognized as dots but can be detected as density and thus are recognized as the developing fog. Further, as regards further small dots, a change in potential becomes small, and therefore, toner dots themselves are not readily formed and thus do not readily cause fog. Thus, when the surface particles are excessively large, the black spot and the developing fog are liable to generate.

On the other hand, according to study by the present inventors, it turned out that when the surface particles are excessively small, it becomes difficult to uniformly disperse the surface particles and thus the surface particles from aggregate with the result that degrees of the developing fog and the black spot are rather worsened. Further, it also turned out that when the surface particles are excessively small, an effect of reducing a contact area between the photosensitive member and the charging member cannot be obtained and thus the contaminant is liable to deposit on the charging member.

That is, in order to suppress the stripe-shaped image density non-uniformity (image stripe) due to the deposition of the contaminant on the charging member, dispersion of the surface particles in the surface layer of the charging member is effective. On the other hand, with a larger particle size of the surface particles, the degrees of the black spot and the developing fog become larger. For that reason, it was difficult to compatibly realize suppression of the deposition of the contaminant on the charging member and suppression of the black spot and the developing fog. Therefore, in this embodiment, as the plurality of kinds of surface particles different in particle size, two kinds of surface particles consisting of first surface particles and second surface particles are dispersed in the surface layer of the charging member, so that the suppression of the deposition of the contaminant on the charging member and the suppression of the black spot and the developing fog are realized in combination. That is, the first surface particles ("large particles") having a particle size less than a particle size in which the developing fog is conspicuous (i.e., less than 20 μm in average particle size) are dispersed on the surface layer of the charging member, so that contamination resistance is ensured. In addition, gaps among the first surface particles are reduced by the second surface particles ("small particles") having a particle size smaller than the particle size of the first surface particles, so that the contamination resistance is maintained while ensuring a parting property of the charging member against the contaminant. As a result, the number of the "large particles" can be reduced compared with the case of using only the "large particles" while suppressing the deposition of the contaminant on the charging member, and therefore, the black spot and the developing fog can be suppressed. In this case, the particle sizes, weights per unit area and projection area ratios of the first and second surface particles are set within predetermined ranges, so that the deposition of the contaminant on the charging member while suppressing the developing fog and local image density non-uniformity such as the black spot. This will be specifically described later.

3. Charging Member

The charging roller 2 in this embodiment will be described. Part (a) of FIG. 3 is a schematic sectional view showing a layer structure of the charging roller 2 in this embodiment.

The charging roller 2 includes a supporting member (electroconductive supporting member, core metal) 2*a*, a base layer (electroconductive elastic layer) 2*b* formed on an outer peripheral surface of the supporting member 2*a*, and a surface layer (outermost layer) 2*c* formed on the base layer 2*b*. The charging roller 2 is rotatably supported by bearing members 2*e* at end portions of the supporting member 2*a* with respect to a rotational axis direction. Further, the charging roller 2 is urged against the surface of the photosensitive drum 1 with a predetermined urging force by urging of the bearing members, provided at the end portions of the supporting member 2*a* with respect to the rotational axis direction, by urging springs, respectively as urging means. The charging roller 2 is rotated by rotation of the photosensitive drum 1.

The supporting member 2*a* is a shaft made of metal (nickel-plated steel) excellent in anti-wearing property and bending stress in this embodiment.

The base layer 2*b* can be formed with a rubber, thermoplastic elastomer or the like conventionally used as a material of the base layer of the charging member. Specifically, as a material of the base layer 2*b*, it is possible to use various thermoplastic elastomers and rubber compositions including a base material rubber, such as polyurethane, silicone rubber, butadiene rubber, isoprene rubber, chloroprene rubber, styrene-butadiene rubber, ethylene-propylene rubber, polynorborene rubber, styrene-butadiene-styrene rubber or epichlorohydrin rubber. Kinds thereof are not particularly limited, but a single or a plurality of kinds of the thermoplastic elastomers selected from general-purpose styrene-based elastomers and olefine-based elastomers can be suitably used. Further, depending on a needed elastic force, a solid rubber or a foam rubber may also be used.

Predetermined electroconductivity can be imparted to the base layer 2*b* by adding an electroconductive agent in the base layer 2*b*. The electroconductive agent is not particularly limited, and it is possible to use cationic surfactants including quaternary ammonium salts such as lauryltrimethylammonium, stearyltrimethylammonium, octadodecyltrimethylammonium, dodecyltrimethylammonium, hexadecyltrimethylammonium, and halogenated benzyl salts including perchlorates, chlorates, fluoroboric acid salts, ethosulfates, benzylbromides and benzylchlorides of modified fatty acid dimethylethyl ammonium; anionic surfactants such as aliphatic sulfonates, higher alcohol sulfates, higher alcohol ethylene oxide adduct sulfates, higher alcohol phosphates, and higher alcohol ethylene oxide adduct phosphates; amphoteric surfactants such as various betaines; antistatic agents including nonionic antistatic agents such as higher alcohol ethylene oxides, polyethylene glycol fatty esters and polyhydric alcohol fatty esters; metal esters of the first group (Li, $Na^+$, $K^+$, etc.) of the periodic system, such as $LiCF_3SO_3$, $NaClO_4$, $LiAsF_6$, $LiBF_4$, NaSCN, KSCN and NaCl; electrolytes such as $NH_4^+$ salts; metal salts of the second group ($Ca^{2+}$, $Ba^{2+}$, etc.) of the periodic system, such as $Ca(ClO_4)_2$; and the above-mentioned antistatic agents having at least one active hydrogen reacting with isocianates of hydroxyl group, carboxyl group, primary amino group and secondary amino group. Further, it is possible to use ion-conductive agents including complexes of the above-mentioned electroconductive agents with polyhydric alcohols, such as 1,4-butanediol, ethylene glycol, polyethylene glycol, propylene glycol and polypropylene glycol, and derivatives of the polyhydric alcohols; electroconductive carbons such as Ketjen black EC and acetylene black; rubber carbons such as SAF, ISAF, HAF, FEF, GPF, SRF, FT and MT; oxidized color (ink) carbons; pyrolytic carbons; natural and artificial graphites; metals and metal oxides, such as antimony-doped tin oxide, titanium oxide, zinc oxide, nickel, copper, silver and germanium; and electroconductive polymers, such as polyaniline, polypyrrole and polyacetylene. In this case, a mixing amount of these electroconductive agents is appropriately selected depending on the kind of the compositions and is in general adjusted in volume resistance of the base layer 2*b* to $10^2$-$10^8$ Ω·cm, preferably $10^3$-$10^6$ Ω·cm.

The surface layer 2*c* can be formed of a resin material suitable as a material forming the surface layer of the charging member. Specifically, it is possible to use polyester resin, acrylic resin, urethane resin, urethane-acryl resin, nylon resin, epoxy resin, polyvinyl acetal resin, vinylidene chloride resin, fluorine-containing resin and silicone resin. These resins of an organic type and aqueous type can be used.

Electroconductivity can be imparted to and adjusted in the surface layer 2*c* by adding an electroconductive agent. In this case, the electroconductive agent is not particularly limited, but it is possible to use electroconductive carbons such as Ketjen black EC and acetylene black; rubber carbons such as SAF, ISAF, HAF, FEF, GPF, SRF, FT and MT; oxidized color (ink) carbons; pyrolytic carbons; natural and artificial graphites; metals or metal oxides, such as antimony-doped tin oxide, titanium oxide, zinc oxide, nickel, copper, silver and germanium. Further, in the case where the above-mentioned electroconductive agents are used in an organic solvent, in consideration of a dispersing property, the surface of the electroconductive agent may preferably be subjected to surface treatment such as silane coupling. Further, in addition amount of the electroconductive agent can be appropriately adjusted so as to have a desired electric resistance. In the case where the electric resistance of the surface layer 2*c* is higher than the electric resistance of the base layer 2*b*, charging of the photosensitive drum 1 is stabilized. The volume resistivity of the surface layer 2*c* may preferably be $10^3$-$10^{15}$ Ω·cm, further preferably be $10^5$-$10^{14}$ Ω·cm.

Part (b) of FIG. 3 is a schematic enlarged view of the surface layer 2*c*. In the material forming the surface layer 2*c*, first surface (layer) particles ("large particles") 21 and second surface (layer) particles ("small particles") 22 having a particle size smaller than a particle size of the first surface particles 21 are dispersed. As the first and second surface particles 21 and 22 added (contained) in the electroconductive resin layer forming the surface layer 2*c*, organic particles or inorganic particles which are insulating particles ($10^{10}$ Ω·cm or more) other than the above-described electroconductive agents can be used. As the organic particles, particles of urethane resin material, urethane-acryl resin material, acryl resin material, acryl-styrene copolymer resin material, polyamide resin material, silicone rubber, epoxy resin material and the like can be cited. Of these particles, it is particularly preferable that the particles of urethane resin material, urethane-acryl resin material, acryl resin material or acryl-styrene copolymer resin material is used since rigidity of the material is not so changed. As the inorganic particles, for example, particles of calcium carbonate, clay, talc, silica and the like can be cited.

Incidentally, in the case where the inorganic particles are used in a solvent-based paint, it is preferable that the inorganic particles are subjected to hydrophobic surface treatment so as to be easily dispersed in the paint. Further, also as regards the organic particles, similarly, organic particles having a good compatibility with the resin material of the surface layer 2*c* may preferably be selected since the particles do not readily cause agglomeration.

Of the average particle sizes of the plurality of surface particles different in particle size, the average particle size (average diameter) of the first surface particles ("large particles") 21 having the relatively large particle size is D1, and the average particle size (average diameter) of the second surface particles ("small particles") 22 having the relatively small particle size is D2 (part (b) of FIG. 3). In this case, in ranges of 9.8 μm≤D1≤15.8 μm and 2.8 μm≤D2≤5.2 μm, a condition of: 3.0≤D1/D2≤5.6 is satisfied. As a result, the image defects such as the black spot and the developing fog due to the excessively large particle size of the surface particles (particularly, the "large particles") can be suppressed. Further, in addition thereto, the generation of aggregate of the surface particles due to the excessively small particle size of the surface particles (particularly, the "small particles") can be suppressed, and a dispersing property between the particles can be improved.

Further, a weight per unit area of the first surface particles 21 is M1, a weight per unit area of the second surface particles 22 is M2, and a weight ratio of the weight of the first surface particles 21 to a total weight of the first and second surface particles 21 and 22 is M1/(M1+M2). In this case, a range of 0.10≤M1/(M1+M2)≤0.32 is satisfied. As a result, about 30-100 particles of the "small particles" can be disposed per one "large particle". For that reason, a phenomenon that a relatively small contaminant such as an external additive is deposited on the charging roller 2 can be suppressed by the "small particles" while suppressing a phenomenon that a relatively large contaminant such as the toner attached to the charging roller 2 is developing fog between the charging roller and the photosensitive drum 1 and thus becomes liable to deposit on the charging roller 2.

The surface roughness (ten-point average roughness Rz) of the surface layer 2*c* achieved by mixing the first and second surface particles 21 and 22 in the above-described manner may preferably be 6 μm or more and 18.8 μm or less. As a result, not only the deposition of the contaminant on the surface of the charging roller 2 due to excessive smoothness of the surface of the charging roller 2 can be suppressed, but also the image defects such as the black spot and the developing fog due to the surface shape of the charging roller 2 can be suppressed.

Further, in order to achieve the above-described surface roughness Rz of the charging roller 2 by mixing the first and second surface particles in the above-described manner, a thickness (layer thickness) d (part (b) of FIG. 3) of the surface layer 3*c* may preferably be 7 μm or more and 20 μm or less. Incidentally, the thickness d of the surface layer 2*c* is an average of measured results thereof at a plurality of positions. As a result, not only a state in which the surface particles cannot sufficiently project at the surface of the charging roller 2 due to an excessively large thickness of the surface layer 2*c* of the charging roller 2 can be suppressed, but also a phenomenon that it becomes difficult for the surface layer 2*c* to hold the surface particles due to an excessively thin surface layer 2*c* can be suppressed.

A weight of an entire solid content of the surface layer 2*c* from which the first and second surface particles 21 and 22 are removed is M0, and a proportion (percentage (%)) of a total weight of the first and second surface particles 21 and 22 per the weight of the entire solid content is an entire weight ratio: (M1+M2)/M0. In this case, the entire weight ratio may preferably be in a range of: 14.5%≤(M1+M2)/M0≤38.9%. As a result, not only a phenomenon that a desired surface roughness of the charging roller 2 cannot be achieved due to an excessively small total mixing amount can be suppressed, but also the image defects such as the black spot and the developing fog resulting from agglomeration of the surface particles due to an excessively large total mixing amount can be suppressed.

A forming method of the surface layer 2*c* is not particularly limited, but a method in which a paint containing respective ingredients is prepared and is coated on the base layer 2*b* by dipping or spray coating and thus a pint film is formed may preferably be used. In the case where the surface layer 2*c* is formed in a plurality of layers, paints for forming the respective layers may only be required to be applied onto associated layers through dipping or spraying.

That is, in this embodiment, a manufacturing method of the charging member includes a step of preparing a surface layer paint by mixing the first and second surface particles into a curable resin (material) solution, a step of forming a film (layer) of the surface layer paint on the base layer, and a step of forming the surface layer by curing the paint layer. Further, in the step of preparing the surface layer paint, the surface layer paint is prepared by mixing the first and second surface particles satisfying the conditions of: 9.8 μm≤D1≤15.8 μm, 2.8 μm≤D2≤5.2 μm and 3.0≤D1/D2≤5.6 so as to satisfy the condition of: 0.10≤M1/(M1+M2)≤0.32.

4. Charging Roller Manufacturing Method

An example of a specific manufacturing method of the charging roller 2 will be described. In the following description, "part(s)" represents "weight part(s)". In the following, the example of the manufacturing method of the charging roller 2 will be described using formulation of the charging roller 2 in "Comparison Example a" described later. In formulations of the charging rollers 2 in embodiments or examples other than the charging roller 2 in "Comparison Example a", the manufacturing method itself is the same except that outer diameters, mixing weight parts and the like of the surface particles are different from each other.

<Preparation of Base Layer>

In an open roll, 100 parts of epichlorohydrin rubber (trade name: "EPICHLOMER CG 102", manufactured by OSAKA SODA), 30 parts of calcium carbonate as a filler, 2 parts of colorant-grade carbon (trade name: "Seat SO", manufactured by Tokai Carbon Co., Ltd.) as a reinforcing material for improving an abrasive property, 5 parts of zinc oxide, 10 parts of a plasticizer (DOP), 3 parts of quaternary ammonium perchlorate represented by the following formula:

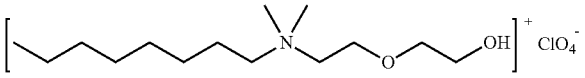

and 1 part of an age resistor (2-mercaptobenzimidazole) were kneaded for 20 minutes, and then, 1 part of a valcanizing accelerator (DM), 0.5 part of valcanizing accelerator (TS) and 1 part of sulfur as a valcanizing agent were further added, followed by kneading for 15 minutes in the open roll. The kneaded product was extruded in a cylindrical shape by a rubber-extruding machine and then was cut. The resultant product was subjected to primary vulcanisation for 40 minutes with water vapor at 160° C. in a valcanizer (valcanizing pan), so that a base layer primary valcanization tube was obtained.

Then, onto a central portion, with respect to an axial direction, of a cylindrical surface of a cylindrical support (electroconductive support) 2*a* (nickel-plated steel), a metal and rubber heat curable adhesive (trade name: "METALOK U-20") was applied, followed by drying at 80° C. for 30 minutes and then drying at 120° C. for 1 hour. The support 2*a* was inserted into the base layer primary valcanization tube and then subjected to secondary valcanization and adhesive curing by heating in an electric oven at 160° C. for 2 hours, so that an un-abraded product was obtained. End portions of a rubber portion of the un-abraded product were cut and then abraded with a rotating grindstone, so that an intermediary product in which a base layer 2*b* having a ten-point average roughness Rz of 7 μm and a runout of 25 μm was formed on the support 2*a* was obtained.

<Preparation of Surface Layer>

To 50 parts of electroconductive zinc oxide powder (trade name: "SN-100P", manufactured by ISHIHARA SANGYO KAISHA, LTD.), 450 parts of 1%-isopropyl alcohol solution of trifluoropropyltrimethoxysilane and 300 parts of glass beads having an average particle size of 0.8 mm were added and dispersed in a paint shaker for 48 hours, and then a dispersion liquid was subjected to filtration with a 500-mesh screen and then was warmed in a hot water bath at 100° C. while stirring a resultant liquid with a Nauta mixer, so that the alcohol was vaporized and the solution was dried. Then, a surface of a resultant (dried) product was subjected to silane coupling with a silane coupling agent, so that surface-treated electroconductive zinc oxide powder was obtained.

Then, 145 parts of lactone-modified acrylic polyol (trade name: "PLACCEL DC2009" (hydroxyl value: 90 KOHmg/g, manufactured by DIACEL CORPORATION) was dissolved in 455 parts of methyl isobutyl ketone (MIBK), so that a solution having a solid content of 24.17% was obtained. To 200 parts of the resultant acrylic polyol solution, 50 parts of the above-obtained surface-treated electroconductive zinc oxide powder, 0.01 part of silicone oil (trade name: "SH-28PA", manufactured by Dow Corning Toray Co., Ltd.) and 1.2 parts of silica fine particles (primary particle size: 0.02 μm) were mixed. To the resultant mixture, 4.5 parts of first surface particles ("large particles") (trade name: "Chemisnow MX-1000" (average particle size: 10 μm), manufactured by Soken Chemical & Engineering Co., Ltd.), 18 parts of second surface particles ("small particles") (trade name: "Chemisnow MX-500" (average particle size: 5 μm), manufactured by Soken Chemical & Engineering Co., Ltd.) and 200 parts of glass beads having an average particle size of 0.8 mm were added. The resultant mixture was placed in a 450 ml-mayonnaise bottle and then wad dispersed for 12 hours using a paint shaker while being cooled.

Further, to 330 parts of the resultant dispersion liquid, 27 parts of isocyanurate trimmer of block type of isophorone diisocyanate (IPDI) (trade name: "VESTNAT B1370", manufactured by Degussa-Huels AG) and 17 parts of isocyanurate trimmer of hexamethylene diisocyanate (HDI) (trade name: "DURANATE TPA-B80E", manufactured by Asahi Kasei Corp.) were mixed and then stirred in a ball mill for 1 hour. Finally, the resultant solution was subjected to filtration with a 200-mesh screen, and a solid content thereof was adjusted to 43 weight %, so that a paint for the surface layer was obtained.

The resultant paint for the surface layer was coated by dipping on the surface of the intermediary product in which the base layer 2*b* was formed on the support 2*a*. Coating was carried out at a pulling speed of 400 mm/min and the paint was air-dried for 30 minutes, and then an axial direction was reversed. Then, the coating was carried out again at the pulling speed of 400 mm/min and the paint was air-dried for 30 minutes, followed by drying in an oven at 160° C. for 1 hour. Then, the resultant product was left standing for 48 hours in an environment of 25° C. in temperature and 50% RH in relative humidity.

5. Measuring Method and Test Method

Next, a measuring method and an evaluation test method of the charging roller 2 will be described.

The average particle sizes D1 and D2 of the first and second surface particles 21 and 22 are center particle sizes and can be measured by the following method. As a measuring device, a Coulter Counter ("Multisizer type II", mfd. by Beckman Coulter Inc.) is used. Further, an interface (mfd. by Nikkaki Bios Co., Ltd.) and a personal computer ("CX-I", mfd. by Canon K.K.) for outputting the number and volume average distributions of the particles are connected with the Coulter Counter. As an electrolytic aqueous solution, 1% NaCl aqueous solution prepared by using a first class grade sodium chloride is prepared. As a measuring method, 0.1-5 ml of a surfactant, preferably alkyl-benzene sulfonate, is added, as dispersant, into 100-150 ml of above-mentioned electrolytic aqueous solution. Then, 2-20 mg of a measuring sample is added to the above mixture. Then, the electrolytic aqueous solution in which the sample is suspended is subjected to dispersion by an ultrasonic dispersing device for about 1-3 minutes. Then, the particle size distribution of the particles which were in a range of 2-40 μm in diameter was obtained with the use of the Coulter Counter (Multisizer type II) fitted with a 100 μm aperture as an aperture. A volume and the number of particles subjected to the measurement are measured, so that a volume distribution and a number distribution are calculation. Then, a particle size $D_{50}$ corresponding to a volume-bias particle distribution can be used as the center particle size which is the average particle size. Further, from the average particle sizes D1 and D2 of the first and second surface particles 21 and 22, the average particle size ratio D1/D2 is derived. Further, from the weight per unit area (M1) of the first surface particles 21 and the weight per unit area (M2) of the second surface particles 22, the weight ratio: M1/(M1+M2) which is a ratio of the weight of the first surface particles 21 to a total weight of the first and second surface particles 21 and 22 is derived. Further, from the weight M0 of the entire solid content of the surface layer 2*c* from which the first and second surface particles 21 and 22 are removed, the entire mixing ratio: "(M1+M2)/M0 which is a proportion (%) of the total weight of the first and second surface particles 21 and 22 to the weight of the entire solid content is derived.

The surface roughness (ten-point average roughness Rz) of the charging roller 2 was measured in the following manner in accordance with JIS 1994. As a measuring device, a surface roughness meter (equivalent for "SE-330H", manufactured by Kosaka Laboratory Ltd.) was used. A measuring condition was 0.8 mm in cut-off, 8 mm in measuring distance, and 0.5 mm/sec is feeding speed. In this measurement, an average value of the ten point average roughness Rz (μm) measured at 3 points with respect to the longitudinal direction and 3 points with respect to a circumferential direction (every 120° with an arbitrary place as a starting point) of the charging roller 2 was acquired.

In order to check whether or not the surface particles are sufficiently projected (exposed) at the surface of the charging roller 2 in actuality, a particle projection area ratio was acquired as an index indicating a proportion of a projection area of the projections resulting from the first and second surface particles 21 and 22, per unit area of the surface of the charging roller 2. The projections resulting from the first and second surface particles may be the first and second surface particles coated with a resin material or the exposed first and second surface particles. For convenience, the projection area ratio of the projections resulting from the first surface particles is also referred to as a "projection area ratio S1 of first surface particles 21", and the projection area ratio of the projections resulting from the second surface particles is also referred to as a "projection area ratio S2 of second surface particles 22". The projection area ratios of the first and second surface particles 21 and 22 were measured in the following manner. The surface of the charging roller 2 was observed (along a direction substantially parallel to a direction normal to the surface of the charging roller 2) using a laser microscope ("VK-8700", manufactured by KEYENCE CORPORATION) including an objective lens with a magnification power of 50 and then was subjected to digital shooting. The resultant image was further enlarged by digital zooming, so that a visual field of 100 μm×100 μm was obtained. In the visual field, the number and area of the projections resulting from the first and second surface particles were acquired, respectively. Thus, the projection area ratio which is a proportion (percentage (%)) of an area (projection area) of the projections of the first surface particles 21 or the second surface particles 22 per entire area of the visual field was calculated. Incidentally, the areas of the projections resulting from the first and second surface particles 21 and 22 can be distinguished from each other by a difference in diameter of the projections. Further, as regards the area of the projections resulting from the first and second surface particles 21 and 22, the area of a portion where in the obtained image, the surface particles clearly protrude from a flat portion other than the projections is acquired. Further, the above-described measurement was carried out 9 points in total including 3 longitudinal points with respect to the longitudinal direction of the charging roller 2, 3 points which are 120° away from the 3 longitudinal points along a circumferential direction of the charging roller 2 in the clockwise direction, and 3 points which are 120° away from the 3 longitudinal points along the circumferential direction of the charging roller 2 in the counter clockwise direction. Average values of the projection area ratios S1 and S2 of the first and second surface particles 21 and 22 were acquired, respectively.

In the case where a diameter of the particles existing at the surface of the charging roller 2 is needed to be directly measured, the surface layer 2*c* of the charging roller 2 was abraded and then the diameter of the particles existing in the abraded region was measured. The measurement was specifically carried out in the following manner. The surface of the surface layer 2*c* of the charging roller 2 before abrasion was observed (along a direction substantially parallel to a direction normal to the surface of the charging roller 2) using the laser microscope ("VK-8700", manufactured by KEYENCE CORPORATION) including the objective lens with a magnification power of 50 and then was subjected to digital shooting. The resultant image was further enlarged by digital zooming, so that a visual field of 100 μm×100 μm was obtained. In the visual field, the diameter of the particles was measured. Here, the number of the particles in the visual field of 100 μm×100 μm varies depending on the formulation of the charging roller 2, but in most cases, the number of the particles falls within a range from several tens of particles to 100 particles. However, in the case where the number of particles falling within the visual field exceeds 100 particles, the number of measuring particles in one measurement was reduced to 100 particles or less by decreasing the visual field to 50 μm×50 μm, for example. On the other hand, in the case where the number of the particles falling within the visual field of 100 μm×100 μm is less than 10 particles, there is a possibility that the number of samples for calculating the diameter of the particles is insufficient and thus an error increases, and therefore, the following method was used. That is, the number of measuring particles in one measurement was adjusted to 40 particles or more by increasing the visual field to 200 μm×200 μm, for example.

Then, the surface layer 2*c* of the charging roller 2 was averagely abraded in a depth of about 1 μm with a fine sandpaper such as "DACS #1000" manufactured by Sankyo-Rikagaku Co., Ltd. while observing the surface layer 2*c* of the charging roller 2. Then, the diameter of the particles of the surface layer 2*c* of the charging roller 2 after the abrasion at the same place as the place observed before the abrasion was measured by the same means. Thereafter, an operation such that the surface layer 2*c* of the charging roller 2 was abraded in a depth of about 1 μm and the diameter of the particles was measured was repeated until the thickness of the surface layer 2*c* became 0 μm. In this manner, when the diameter of the particles is measured after the surface layer 2*c* of the charging roller 2 was abraded, a measured diameter of the particles gradually increases, but when the surface layer 2*c* of the charging roller 2 is further abraded, the measured diameter of the particles gradually decreases. Then, of the diameters of the particles at the same position, the largest value of the diameters of the abraded particles is used as a true diameter, so that a value of the diameter of the particles on the charging roller 2. As a method of acquiring the weight M1 or M2 per unit area of the above-described particle, the weight M1 or M2 can be acquired from the particle diameter obtained in the above-described manner and the number of the particles per predetermined area. That is, when a volume of the particles is known, individual weights of the particles can be acquired by multiplying the volume of the particles by specific gravity of the particles. Here, as a method of determining the specific gravity of the particles, the particles are taken out form the surface layer 2*c* of the charging roller 2 and are subjected to elementary analysis by a method such as GS/CM, so that the specific gravity of the particles can be determined. Thus, when the weight of the individual particle and the number of the particles per predetermined area are determined, the weight of the particles in the solid content is acquired, so that it becomes possible to acquire the weight ratio in the case where a plurality of kinds of particles are used.

In this experiment, as described above, per one place, at least 40 particles and at most 100 particles are subjected to measurement at the 9 points in total including the 3 longitudinal points of the charging roller 2, the 3 points which are 120° away from the 3 longitudinal points in the clockwise direction, and the 3 points which are 120° away from the 3 longitudinal points in the counterclockwise direction. Then, the number of the particles is calculated in a range from at least 360 particles to at most 900 particles, and a distribution thereof is obtained. As a result, whether a single kind of the particles or a plurality of kinds of particles are distributed was discriminated, and values of the center diameters D1 and D2 of the particles and the weights M1 and M2 per unit area of the particles were acquired.

Further, evaluation tests (durability test and image evaluation test) of the charging roller 2 were conducted in the following manner. In the tests, the image forming apparatus 100 for outputting A3R sheets in accordance with the present invention was used. A process speed (transfer material P outputting speed) is 250 mm/sec, and an image resolution is 600 dpi. Further, the photosensitive drum 1 is a photosensitive drum of a reverse development type, in which a 20 μm-thick OPC layer was coated on an aluminum cylinder. The toner is prepared by subjecting a pulverization toner base material which is formed of a polyester resin material as a principal material in a volume average particle size of 6.5 μm and in which a wax is added internally, to external addition treatment with silica or the like.

The durability test was conducted in a manner such that the charging roller 2 as a test object was incorporated into the image forming apparatus 100 and images with an image ratio of 5% were outputted continuously on 100,000 sheets in a low temperature/low humidity (L/L: 15° C./10% RH) environment.

In the image evaluation test, first, a degree of generation (occurrence) of the black spot was evaluated by outputting a half-tone image in an initial state (before the durability test), and then a degree of generation (occurrence) of the stripe-shaped image density non-uniformity (image stripe) due to the contaminant on the charging roller 2 was evaluated by outputting the half-tone image after the durability test. Further, separately from these evaluations, in the initial state and after the durability test, as an index of an amount of the toner caused the developing fog (hereinafter, also referred to as "fog toner"), a fog density on the photosensitive drum 1 was measured. The fog density on the photosensitive drum 1 was measured in the following manner. First, during image formation of a predetermined image (such as a solid white image), a driving motor of the photosensitive drum 1 was forcedly stopped, and a polyester tape was applied onto the photosensitive drum 1 at a non-image portion in a position between the developing position (developing portion) and the primary transfer position (primary transfer portion) on the photosensitive drum 1, and the toner in the position was collected. The polyester tape was peeled off from the photosensitive drum 1 and was applied onto white paper, and then a reflection density of the polyester tape portion on the white paper was measured using a white photometer ("TC-6DS/A", manufactured by Tokyo Denshoku Co., Lfd.). Separately, the same polyester tape was applied onto new (fresh) white paper, and the reflection density of the polyester tape portion on the white paper was measured using the same white photometer. A density difference (%) between the above-measured two reflection densities was evaluated as the fog density on the photosensitive drum 1. The reason why the amount of the fog toner was evaluated by the fog density on the photosensitive drum 1 is as follows. The fog toner on the photosensitive drum 1 has no normal electric charges in most cases, and in some cases, includes the toner having polarity-inverted electric charges and the toner having electric charges of substantially zero. For that reason, when the amount of the fog toner is intended to be evaluated on the paper, in the case where the fog toner which is not transferred onto the paper exists, the amount of the fog toner cannot be properly evaluated in some instances.

The black spot generating due to a deficiency of the surface shape of the charging roller 2 in the initial state was evaluated by observing the outputted half-tone image with eyes. At this time, the case where the black spot did not generate at all was evaluated as "◎ (very good)", the case where the black spot generated but was very slight and was not recognized until the black spot was closely observed was evaluated as "o (good)", the case where the black spot was slight but was on an apparently recognizable level was evaluated as "A (somewhat poor)", and the case where the black spot was on a clearly conspicuous level was evaluated as "x (poor)". Further, the stripe-shaped image density non-uniformity (image stripe) due to the contaminant on the charging roller 2 after the durability test was evaluated by observing the outputted half-tone image with eyes since a deviation is liable to generate between a value measured as the density and a result of eye observation. At this time, the case where the black spot did not generate at all was evaluated as "◎ (very good)", the case where the black spot generated but was very slight and was not recognized until the black spot was closely observed was evaluated as "o (good)", the case where the black spot was slight but was on an apparently recognizable level was evaluated as "Δ (somewhat poor)", and the case where the black spot was on a clearly conspicuous level was evaluated as "x (poor)". Further, as regards the fog density, the case where the fog density was 0.5% or less was evaluated as "◎ (very good)", the case where the fog density was more than 0.5% and 1.0% or less was evaluated as "o (good)", the case where the fog density was more than 1% and 2% or less was evaluates "Δ (somewhat poor)", and the case where the fog density was more than 2% was evaluated as "x (poor)".

6. Evaluation Result

Formulations and results of the evaluation tests of the charging rollers 2 in "Embodiment A" to "Embodiment D" and "Comparison Example a" to "Comparison Example j" are shown in Table 1 appearing hereinafter.

Comparison Example a

"Comparison Example a" is a reproduction test of the charging roller 2 in accordance with Japanese Patent No. 4047057. The average particle size D1 of the large particles is 19.2 the average particle size of the small particles is 5.2 μm, the weight ratio: M1/(M1+M2) of the large particles is 0.90. Further, the total weight ratio: (M1+M2)/M0 is 14.4%, and the thickness of the surface layer 2*c* is 25 μm. In Comparison Example a, the black spot did not generate in the initial state and the evaluation of the contaminant on the roller after the durability test was contact, but the evaluation of the fog density in the initial state was Δ.

Comparison Examples b to d

Next, in order to check an effect of only the large particles, evaluation of the following three kinds of the charging rollers 2 was performed. That is, the three kinds of the charging rollers 2 were the charging roller 2 of "Comparison Example b" in which only the large particles are used as the surface particles and the average particle size D1 is 19.2 μm, the charging roller 2 of "Comparison Example c" in which only the large particles are used as the surface particles and the average particle size D1 is 15.8 μm, and the charging roller 2 of "Comparison Example d" in which only the large particles are used as the surface particles and the average particle size D1 is 9.8 μm. As a result, the black spot evaluation in the initial state was Δ in "Comparison Example b", "Comparison Example c" and "Comparison Example d". When the surfaces of these charging rollers 2 were observed through an optical microscope, minute undulations and creases were observed at the surfaces and a portion when the surface particles agglomerated together was observed in some places. It would be considered that the worsening of the evaluation of the black spot in the initial state is caused by these defects. That is, it was able to be re-confirmed that in order to maintain a dispersing property of the particles and to prevent the generation of agglomeration of the particles, there is a need to use at least the plurality of kinds of the surface particles different in particle size.

However, in "Comparison Example c" and "Comparison Example d" in which the average particle size D1 is made smaller than the average particle size D1 in "Comparison Example b", a degree of the fog density was improved, so that it turned out that the degree of the fog density can be improved when the particle size is small even in the case where the single kind of the surface particles is used. On the other hand, in "Comparison Example c" and "Comparison Example d", compared with "Comparison Example b", the image stripe after the durability test was worsened, so that it turned out that when the single kind of the surface particles was decreased in particle size, the degree of the contaminant on the charging roller 2 was worsened. That is, it turned out that only by the sing kind of the surface particles, all of the black spot, the developing fog and the contaminant on the charging roller 2 cannot be sufficiently suppressed.

Comparison Example e

Next, evaluation of the charging roller 2 of "Comparison Example e" in which compared with "Comparison Example a", the amount of the large particles is decreased to about ¼, the amount of the small particles is increased to about 10 times, and the weight ratio: M1/(M1+M2) is lowered to 0.20 was carried out. As a result, compared with "Comparison Example a", a tendency that the fog density was somewhat improved appeared.

Comparison Example f

Next, evaluation of the charging roller 2 of "Comparison Example f" in which compared with "Comparison Example e", the average particle size D1 of the large particles is decreased from 19.2 μm to 15.8 μm was carried out. As a result, the fog density was further improved from Δ in "Comparison Example e" to 0. However, the thickness of the surface layer 2*c* is 25 whereas the average particle size D1 of the large particles is decreased to 15.8 μm, and therefore, the surface roughness Rz is decreased to 4.2 μm, so that the image stripe was worsened from ◎ to Δ.

Embodiment A

Next, evaluation of the charging roller 2 of "Embodiment A" was carried out. In "Embodiment A", the average particle size D1 of the large particles is 15.8 μm, and the average particle size of the small particles is 5.2 μm. Further, in "Embodiment A" compared with "Comparison Example f", the weight ratio: M1/(M1+M2) of the large particles is decreased to 0.10, the thickness of the surface layer 2*c* is decreased to 20 μm, and the surface roughness Rz is increased to 6.0 μm. As a result, the black spot in the initial state did not generate and the evaluation was @, and also the fog density in the initial state was 0.5% or less and the evaluation was ◎. After the durability test, the evaluation of the fog density was ○, and the image stripe was very slight and the evaluation was ○.

From the above result, it turned out that in order to improve the black spot and the developing fog, there is at least a need that the average particle size of the surface particles is 15.8 μm or less. Further, it turned out that in order to improve the contaminant on the charging roller 2 while improving the black spot and the developing fog, the surface roughness Rz of 6.0 μm or more is suitable. Further, it turned out that as regards the weight ratio: M1/(M1+M2) of the large particles, the range from 0.70 to 0.90 is not suitable and a lower value is suitable.

Embodiment B

Next, evaluation of the charging roller 2 of "Embodiment B" in which compared with "Embodiment A", the surface roughness Rz is increased to 18.8 μm by decreasing the thickness of the surface layer 2*c* to 15 μm and by increasing the weight ratio: M1/(M1+M2) of the large particles to 0.32 was carried out. As a result, all of the evaluations of the black spot, the fog density and the image stripe were ◎.

Comparison Example g

Next, evaluation of the charging roller 2 of "Comparison Example g" in which compared with "Embodiment B", the weight ratio: M1/(M1+M2) of the large particles is increased to 0.35 and the surface roughness Rz is increased to 19.2 μm was carried out. As a result, in the initial state, the black spot and the fog density were evaluated as Δ. When the surface of this charging roller 2 was observed through the optical microscope, the agglomeration of the large particles and the small particles was observed. From this result, it would be considered that the dispersing property of the surface particles is worsened by an excessively increased amount of the surface particles and thus the black spot and the developing fog generate.

Comparison Example h

Next, evaluation of the charging roller 2 of "Comparison Example h" in which compared with "Embodiment B", the weight ratio: M1/(M1+M2) of the large particles is decreased to 0.08 was carried out. As a result, the image stripe was worsened although the surface roughness Rz of the charging roller 2 was 6.0 μm or more. This would be considered because the contact area between the photosensitive drum 1 and the charging roller 2 is increased by an excessively decreased in the number of the large particles, and thus in combination with the abrasion of the large particles in the durability test, the contaminant of the photosensitive drum 1 is liable to deposit on the charging roller 2.

From the above results, in order to improve the contaminant on the charging roller 2 (image stripe) while improving the black spot and the developing fog, the weight ratio: M1/(M1+M2) of the large particles may preferably be in a range of 0.10 or more and 0.32 or less. Further, the surface roughness Rz may preferably be in a range of 6.0 μm or more and 18.8 μm or less. However, even when the surface roughness Rz falls within this range, the evaluation of the contaminant on the charging roller 2 is poor in some instances in the case where the single kind of the surface particles is used, and therefore, at least two kinds of the surface particles different in center diameter are needed.

Next, in order to check lower limits of the average particle sizes D1 and D2 of the large particles and the small particles, respectively, evaluations of the following four kinds of the charging rollers of "Comparison Example i", "Embodiment C", "Comparison Example j" and "Embodiment D" were carried out.

Comparison Example i

First, the evaluation of the charging roller 2 of "Comparison Example i" was carried out. In "Comparison Example i", while maintaining the weight ratio: M1/(M1+M2) of the large particles in the range of 0.10 or more and 0.32 or less, the average particle size D1 of the large particles was 9.8 μm and the average particle size D2 of the small particles was 5.2 μm. That is, the diameter ratio: D1/D2 between the large particles and the small particles was 1.9. Further, in "Comparison Example i", the thickness of the surface layer 2*c* was 10 and the surface roughness Rz was 10.6 As a result, the evaluations of the black spot and the developing fog were A. This would be considered because when the average particle size D2 of the small particles is excessively close to the average particle size D1 of the large particles, an effect of improving the dispersing property between the surface particles by using the plurality of kinds of the surface particles different in particle size was lowered.

Embodiment C

Next, evaluation of the charging roller 2 of "Embodiment C" was carried out. In "Embodiment C", while maintaining the weight ratio: M1/(M1+M2) of the large particles in the range of 0.10 or more and 0.32 or less, the average particle size D of the large particles was 9.8 μm, and the average particle size D1 of the small particles was 2.8 μm. That is, the diameter ratio: D1/D2 between the large particles and the small particles was 3.5. Further, in "Embodiment C", the surface roughness Rz was 8.1 μm by decreasing the thickness of the surface layer 2*c* to 7 μm. As a result, although the surface particles were small, a result such that all of the black spot, the developing fog and the contaminant on the charging roller 2 was evaluated as o or better was obtained.

Comparison Example j

Next, evaluation of the charging roller 2 of "Comparison Example j" was carried out. In "Comparison Example j", while maintaining the weight ratio: M1/(M1+M2) of the large particles in the range of 0.10 or more and 0.32 or less, the average particle size D of the large particles was 4.9 μm, and the average particle size D1 of the small particles was 1.8 μm. That is, the diameter ratio: D1/D2 between the large particles and the small particles was 2.7. Further, in "Comparison Example j", the surface roughness Rz was 5.2 μm. As a result, the evaluation of the black spot in the initial state and the image stripe after the durability test were x. In a state in which the average particle size D2 was 1.8 μm, the surface roughness Rz did not exceed 6.0 μm even when the amount of the small particles was increased, so that the agglomeration generated and thus the black spot was worsened.

Embodiment D

Next, evaluation of the charging roller 2 of "Embodiment D" was carried out. In "Embodiment D", while maintaining the weight ratio: M1/(M1+M2) of the large particles in the range of 0.10 or more and 0.32 or less, the average particle size D of the large particles was 15.8 μm, and the average particle size D1 of the small particles was 2.8 μm. That is, the diameter ratio: D1/D2 between the large particles and the small particles was 5.6. Further, in "Embodiment D", the thickness of the surface layer 2*c* was 11 μm and the surface roughness Rz of the surface layer 2*c* was 14.2 μm. As a result, a result such that all of the black spot, the developing fog and the contaminant on the charging roller 2 was evaluated as o or better was obtained.

From the above results, the average particle size D1 of the large particles may preferably be in a range of 9.8 μm or more and 15.8 μm or less. The average particle size D2 of the small particles may preferably be in a range of 2.8 μm or more and 5.2 μm or less. Further, when the average particle size D2 of the small particles is excessively close to the average particle size D1 of the large particles, an effect of the use of the plurality of kinds of the surface particles different in particle size cannot be sufficiently obtained. For that reason, the diameter ratio: D1/D2 between the large particles and the small particles may preferably be in a range of 3.0 or more and 5.6 or less.

Further, as regards the weight M1 of the large particles and the weight M2 of the small particles, the weight ratio: M1/(M1+M2) of the large particles may preferably be in a range of 0.10 or more and 0.32 or less.

Further, the thickness of the surface layer 2*c* may preferably be in a range of 7.0 μm or more and 20 μm or less.

Further, an interrelation of the projection area ratio S1 of the large particles and the projection area ratio S2 of the small particles with the black spot and the fog density of the charging rollers of "Embodiment A" to "Embodiment D" and "Comparison Example a" to "Comparison Example j" was checked. As a result, it turned out that the projection area ratio S1 of the large particles is suitable in a range of 1.0% or more and 3.9 or less. It also turned out that the projection area ratio S2 of the small particles is suitable in a range of 13.5% or more and 25.5% or less. That is, the projection area ratios S1 and S2 may preferably satisfy: 1.0%≤S1≤3.9% and 13.5%≤S2≤25.5%.

TABLE 1

| | Formulation | | | | | | | | | | | | | |
|---|---|---|---|---|---|---|---|---|---|---|---|---|---|---|
| CE*1 OR E*2 | CE a | CE b | CE c | CE d | CE e | CE f | E A | E B | CE g | CE h | CE i | E C | CE j | E D |
| D1 (μm) | 19.2 | 19.2 | 15.8 | 9.8 | 19.2 | 15.8 | 15.8 | 15.8 | 15.8 | 15.8 | 9.8 | 9.8 | 4.9 | 15.8 |
| D2 (μm) | 5.2 | — | — | — | 5.2 | 5.2 | 5.2 | 5.2 | 5.2 | 5.2 | 5.2 | 2.8 | 1.8 | 2.8 |
| D1/D2 | 3.7 | — | — | — | 3.7 | 3.0 | 3.0 | 3.0 | 3.0 | 3.0 | 1.9 | 3.5 | 2.7 | 5.6 |
| M1/(M1 + M2) | 0.90 | — | — | — | 0.20 | 0.12 | 0.10 | 0.32 | 0.35 | 0.08 | 0.12 | 0.18 | 0.10 | 0.29 |
| (M1 + M2)/M0 (%) | 14.4 | 14.4 | 14.4 | 14.4 | 19.9 | 18.1 | 22.2 | 38.9 | 51.1 | 45.7 | 37.6 | 26.9 | 6.5 | 14.5 |
| TAR*3 | 15.1 | 18.8 | 13.4 | 8.4 | 16.1 | 4.2 | 6.0 | 18.8 | 19.2 | 8.9 | 10.6 | 8.1 | 5.2 | 14.2 |
| TH*4 (μm) | 25 | 25 | 25 | 25 | 25 | 25 | 20 | 15 | 15 | 15 | 10 | 7 | 7 | 11 |
| FD*5 (%) | 1.7 | 2.1 | 0.7 | 0.3 | 1.2 | 0.5 | 0.5 | 0.5 | 1 | 0.5 | 0.5 | 0.3 | 0.3 | 0.3 |
| | Δ | X | ○ | ◎ | Δ | ○ | ◎ | ◎ | Δ | ◎ | Δ | ◎ | ◎ | ◎ |
| BS*6 | ◎ | Δ | Δ | Δ | ◎ | ◎ | ◎ | ◎ | Δ | ◎ | Δ | ○ | X | ○ |
| IS*7 | ◎ | ○ | Δ | X | ◎ | Δ | ○ | ◎ | ◎ | Δ | ○ | ○ | X | ○ |
| S1 (%) | 6.7 | 6.8 | 4.6 | 1.8 | 1.7 | 1.2 | 1.0 | 3.9 | 5.7 | 1.2 | 1.5 | 1.1 | 0.3 | 1.0 |
| S2 (%) | 2.3 | — | — | — | 25.5 | 25.5 | 25.5 | 25.5 | 31.9 | 40.4 | 21.2 | 18.5 | 7.6 | 13.5 |

*1: "CE" is Comparison Example.
*2: "E" is Embodiment.
*3: "TAR" is the ten-point average roughness.
*4: "TH" is the thickness (μm).
*5: "FD" is the fog density (%) on the photosensitive drum.
*6: "BS" is the black spot (image defect).
*7: "IS" is the image stripe (contaminant on the charging roller).

As described above, in this embodiment, in the constitution employing the DC charging type, the particle sizes and weight ratio per unit area of the two kinds of the surface particles 21 and 22 different in particle size and dispersed in the surface layer 2*c* of the charging roller 2 are caused to fall within the predetermined ranges, so that the surface shape of the charging roller 2 is controlled. As a result, it becomes possible to suppress the generation of the image defects by improving the charge uniformity and by suppressing the deposition of the contaminant on the charging roller 2. That is, according to this embodiment, in the constitution using the DC charging type, the deposition of the contaminant on the charging member can be suppressed while suppressing the local image density non-uniformity such as the black spot and suppressing the developing fog.

Embodiment 2

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

In recent years, in order to realize lifetime extension of the photosensitive drum 1, the surface layer (layer positioned on an outermost surface of the photosensitive drum 1 (outermost layer)) of the photosensitive drum 1 has been decreased in abrasion (wearing) degree. For example, as the surface layer of the photosensitive drum 1, a protective layer formed with a curable resin material as a binder resin material in some cases (Japanese Patent No. 3944072 or the like)

FIG. 10 is a schematic sectional view showing a layer structure of the photosensitive drum 1 in this embodiment. In this embodiment, the photosensitive drum 1 is a negatively chargeable drum-shaped organic photosensitive member (OPC) in which an original material is used as a photo-conductive material (charge generating material and charge transporting material) similarly as in Embodiment 1. This photosensitive drum 1 has a lamination structure in which on a substrate (electroconductive substrate) 1*a*, three layers consisting of a charge generating layer 1*b*, a charge transporting layer 1*c* and a protective layer 1*d* are laminated from below in a named order. Further, between the substrate 1*a* and the charge generating layer 1*b*, an intermediary layer (undercoat layer) having a barrier function and an adhesive function and an electroconductive layer for preventing an interference fringe may also be provided. In this embodiment, the protective layer 1*d* is formed using a curable phenolic resin material as the binder resin material. Incidentally, the binder resin material of the surface layer of the photosensitive drum 1 is not limited thereto, but an arbitrary available curable material can be used. For example, a technique such that a cured film obtained by curing a monomer having a C═C (double) bond with heat or light energy is used as the surface layer of the photosensitive drum 1. Further, in this embodiment, the surface layer of the photosensitive drum 1 is the protective layer, but this protective layer may also contain electroconductive particles.

The surface layer of the photosensitive drum 1 may also have, in addition to a function as the protective layer, a function as the charge transporting layer (even when another charge transporting layer is provided under the charge transporting layer, these layers may also be regarded as substantially a single charge transporting layer) containing a charge transporting material.

In this embodiment, an elastic deformation power of the surface of the photosensitive drum 1 is 47% or more (particularly, 48% in this embodiment). As a result, abrasion of the surface of the photosensitive drum 1 due to friction between the surface of the photosensitive drum 1 and the cleaning blade 6*a* is suppressed, so that lifetime extension of the photosensitive drum 1 is realized.

The elastic deformation power is a value measured using a microhardness measuring device ("FISHER SCOPE H100V", manufactured by Fisher Instruments K.K.) in an environment of 25° C./50% RH (relative humidity). This device is capable of acquiring a continuous hardness by causing a penetrator (indenter) to contact a measuring object (surface of the photosensitive drum 1) and then by directly reading an indentation depth under a load continuously exerted on the penetrator (indenter). As the indenter, a Vickers quadrangular pyramid diamond indenter with an angle between opposite forces of 136 degrees is used. A final load continuously exerted on the indenter is 6 mN, a retention time in which a state that the final load of 6 mN is exerted on the indenter is retained was 0.1 sec. Further, the number of measuring points was 273 points.

FIG. 5 is a graph for illustrating a measuring method of the elastic deformation power of the surface of the photosensitive drum 1. In FIG. 5, the ordinate represents a load F (mN) exerted on the penetrator (indenter), and the abscissa represents an indentation depth h (μm) of the penetrator (indenter). FIG. 5 shows a result when the load exerted on the indenter is stepwisely increased up to a maximum (6 mN in this case) (A to B), and then is stepwisely decreased (B to C). The elastic deformation power can be acquired from a change in amount of work (energy) of the indenter on the measuring object (surface of the photosensitive drum 1), i.e., a change in energy caused by increase and decrease of the load of the indenter on the measuring object (surface of the photosensitive drum 1). Specifically, a value obtained by dividing an elastic deformation work amount We by an entire work amount Wt (We/Wt) is the elastic deformation power (represented by percentage (%)). The entire work amount Wt is represented by an area of a region enclosed by A-B-D-A in FIG. 5, and the elastic deformation work amount We is represented by an area of a region enclosed by C-B-D-C in FIG. 5.

When the elastic deformation power of the surface of the photosensitive drum 1 is excessively small, an elastic force of the surface of the photosensitive drum 1 is insufficient, so that abrasion of the surface of the photosensitive drum 1 is liable to generate at a contact portion between the photosensitive drum 1 and a contact member such as the cleaning blade 6*a*. The elastic deformation power of the surface of the photosensitive drum 1 is made 47% or more, whereby it turns out that lifetime extension of the photosensitive drum 1 can be realized by remarkably suppressing the abrasion of the surface of the photosensitive drum 1 compared with the case where the elastic deformation power is less than 47%. On the other hand, when the elastic deformation power of the surface of the photosensitive drum 1 is excessively large, an amount of plastic deformation of the surface of the photosensitive drum 1 also becomes large that minute scars on the surface of the photosensitive drum 1 are liable to generate at a contact portion between the photosensitive drum 1 and a contact member such as the cleaning blade 6*a*. For that reason, it turns out that the elastic deformation power of the surface of the photosensitive drum 1 may preferably be made 60% or less. Incidentally, the elastic deformation power of the surface of the photosensitive drum 1 can be adjusted depending on a combination of a material with a manufacturing condition.

As described above, in this embodiment, the lifetime extension of the photosensitive drum 1 is realized by decreasing the abrasion degree of the surface layer of the photosensitive drum 1. However, in such a constitution, there is a tendency that the surface of the photosensitive drum 1 caves in by friction with, for example, a carrier of the developer and thus a hole is easily formed. For that reason, in such a constitution, due to a gap between the cleaning blade 6*a* and the hole, there is a tendency that the toner and the external additive are liable to slip through the cleaning blade 6*a* and thus the contaminant is liable to deposit (generate) on the charging roller 2.

As another problem, when the surface layer of the photosensitive drum 1 is decreased in abrasion degree, there is a tendency that a slip generates between the charging roller 2 and the photosensitive drum 1. When the slip generates, the charging roller 2 is not properly rotated by the photosensitive drum 1, so that the charging uniformity of the photosensitive drum 1 lowers or the abrasion of the surface of the photosensitive drum 1 is accelerated in some cases. This slip is liable to generate since the contact ratio between the charging roller 2 and the photosensitive drum 1 decreases with a larger surface roughness of the photosensitive drum 1.

On the other hand, in this embodiment, similarly as in Embodiment 1, the surface shape of the charging roller 2 is controlled by causing the particle sizes and weight ratio of the two kinds of the surface particles 21 and 22 different in particle size and dispersed in the surface layer 2*c* of the charging roller 2 to fall within predetermined ranges. As a result, even in a constitution in which the surface layer of the photosensitive drum 1 is decreased in abrasion degree, it turned out that the charging uniformity can be improved and the deposition of the contaminant on the charging roller 2 can be suppressed. Further, the number of the large particles can be decreased compared with the case of using only the large particles, and therefore, an excessive increase in surface roughness of the charging roller 2 more than necessary is suppressed, and therefore, it turned out that an effect of decreasing a degree of the slip between the charging roller 2 and the photosensitive drum 1 is also achieved.

Embodiment 3

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

When the degree of abrasion of the surface layer of the photosensitive drum 1 is decreased, a frictional force between the photosensitive drum 1 and the cleaning blade 6*a* increases, so that the shuddering (abnormal vibration), the turning-up (phenomenon that a free end of the cleaning blade 6*a* is turned up with respect to the rotational direction of the photosensitive drum 1), chipping and abrasion (wearing) of the cleaning blade 6*a* are liable to generate. Therefore, in order to suppress the above inconveniences by controlling the frictional force between the photosensitive drum 1 and the cleaning blade 6*a*, the surface of the photosensitive drum 1 is provided with a plurality of independent recesses (recessed portions) (Japanese Patent No. 4101278).

In this embodiment, on the surface (specifically, the surface of the protective layer 1*d* similar to that in Embodiment 2) of the photosensitive drum 1, the plurality of independent recesses as described above are formed. FIG. 6 is a schematic view of a part of the surface of the photosensitive drum 1 in this embodiment as seen in a vertical direction of the surface of the photosensitive drum 1.

Circular portions (each having a downward dome-shape in cross-section substantially parallel to a circumferential direction of the photosensitive drum 1 in FIG. 6 are specific recesses, an a portion other than the circular portions is a flat portion.

Typically, the recesses are provided so that when a square region having one side is parallel to the rotational direction of the develop and having each side of 500 μm (500 μm×500 μm) is provided at an arbitrary position of the surface of the photosensitive drum 1, an areal ratio of the specific recesses satisfying a predetermined condition in this region is a predetermined value.

Here, definitions and the like of the specific recesses and the flat portion in the 500 μm-square region will be described. The specific recesses and the flat portion of the surface of the photosensitive drum 1 can be observed with, for example, a laser microscope, an optical microscope, an electron microscope, an atomic force microscope or the like. First, the surface of the photosensitive drum 1 is observed with the microscope or the like in an enlarged state. In the case where the surface of the photosensitive drum 1 is a curved surface such that the photosensitive drum surface is curved along the rotational direction of the photosensitive drum 1, a cross-sectional profile of the curved surface is extracted and the curved line is subjected to fitting. The cross-sectional profile is corrected so that the curved line is a rectilinear line, and a plane obtained by extending the resultant rectilinear line in the longitudinal direction of the photosensitive drum 1 is a reference plane. A region in which a height difference from the resultant reference plane falls within a predetermined range (for example within ±0.2 μm) is defined as the flat portion of the 500 μm-square region. Portions positioned under the flat portion are defined as the (specific) recesses. Further, as regards a depth and a maximum opening diameter, a maximum diameter from the flat portion to bottoms of the recesses is a depth of the recesses, and cross-sectional portions of the recesses at a level of the flat portion are openings of the recesses. Of lengths of line segments crossing the openings, the length of the longest line segment is the maximum opening diameter of the recesses.

The recesses of the surface of the photosensitive drum 1 can be formed by a method (imprinting) in which a mold having a predetermined shape is press-contacted the surface of the photosensitive drum 1 and the predetermined shape is transferred onto the photosensitive drum surface. For example, the mold is continuously contacted to the surface (peripheral surface) of the photosensitive drum 1 by a press-contact shape transfer processing device including the mold while rotating the photosensitive drum 1, and the photosensitive drum surface is processed by the processing device. As another method, a method in which recesses having a predetermined shape are formed on the surface of the photosensitive drum 1 or the like method is also known.

Incidentally, the plurality of specific recesses provided on the peripheral surface of the photosensitive drum 1 may be such that all the specific recesses have the same shape, maximum opening diameter and depth, but may also be such that the specific recesses include those different in shape, maximum opening diameter and depth in mixture. Further, the shape of the specific recesses (i.e., both of a surface shape as seen in a normal direction to the surface of the photosensitive drum 1 and a cross-sectional shape substantially parallel to the circumferential direction of the photosensitive drum 1) is not limited to the above-described shape in this embodiment, but may also be an arbitrary shape as desired. As the shape, for example, a circular shape, an elliptical shape, a square shape, a rectangular shape, and polygonal shapes such as a triangular shape, a quadrangular shape, a pentagonal shape and a hexagonal shape can be cited. Further, the specific recesses may also be disposed in proper alignment or a random alignment.

In this embodiment, the recesses are formed on the surface of the photosensitive drum 1 by imprinting. Further, in this embodiment, the specific recesses have a circular shape of 30 μm in maximum opening diameter (size) when viewed from the normal direction to the surface of the photosensitive drum 1, and have a depth of 0.7 μm and an areal ratio of 56%. Incidentally, the areal ratio of the specific recesses is a proportion (represented by a percentage (%)) of a total of opening areas of the specific recesses to the sum of the total of opening areas of the specific recesses and a total of areas of portions other than the specific recesses.

As described above, in this embodiment, the surface of the photosensitive drum 1 is provided with the plurality of independent recesses (recessed portions), so that the shuddering, the turning-up, the breakage and the abrasion of the cleaning blade 6*a* are suppressed and thus lifetime extension of the cleaning blade 6*a* is realized. However, in such a constitution, there is a tendency that due to a gap between the cleaning blade 6*a* and the recesses of the surface of the photosensitive drum 1, the toner and the external additive are liable to slip through the cleaning blade 6*a* and thus the contaminant on the charging roller 2 is liable to generate. Further, the contact ratio between the charging roller 2 and the photosensitive drum 1 is decreased by the recesses of the surface of the photosensitive drum 1, so that there is a tendency that the slip is liable to generate between the charging roller 2 and the photosensitive drum 1.

On the other hand, in this embodiment, similarly as in Embodiment 1, the surface shape of the charging roller 2 is controlled by causing the particle sizes and weight ratio of the two kinds of the surface particles 21 and 22 different in particle size and dispersed in the surface layer 2*c* of the charging roller 2 to fall within predetermined ranges. As a result, even in a constitution in which on the surface of the photosensitive drum 1, the plurality of independent recessed portions are formed, it turned out that the charging uniformity can be improved and the deposition of the contaminant on the charging roller 2 can be suppressed. Further, the number of the large particles can be decreased compared with the case of using only the large particles, and therefore, an excessive increase in surface roughness of the charging roller 2 more than necessary is suppressed, and therefore, it turned out that an effect of decreasing a degree of the slip between the charging roller 2 and the photosensitive drum 1 is also achieved.

OTHER EMBODIMENTS

The present invention was described based on the specific embodiments mentioned above, but is not limited to the above-mentioned embodiments.

In the above-described embodiments, as the charging type of the image forming apparatus, the DC charging type was employed, but the present invention is not limited thereto and is also applicable to a constitution employing an AC charging type.

In the above-described embodiments, the two kinds of the surface (layer) particles are dispersed in the surface layer of the charging roller, but three or more kinds of surface particles may also be dispersed in the surface of the charging roller. For example, third surface particles smaller in average particle size than the second surface particles in the above-described embodiment may also be contained in the surface layer of the charging roller.

Further, in the above-described embodiments, the image forming apparatus was the color image forming apparatus including the plurality of image forming portions, but the present invention is also applicable to a monochromatic (single color) image forming apparatus including only one image forming portion.

Further, the charging member is not limited to the roller-shaped member, but may also be a member, which is stretched by a plurality of stretching rollers and which is formed in an endless belt shape or in a blade shape. The image bearing member is not limited to the drum-shaped photosensitive member (photosensitive drum), but may also be an endless belt-shaped photosensitive member (photosensitive member belt). When the image forming apparatus is of an electrostatic recording type, the image bearing member is an electrostatic recording dielectric member formed in a drum shape or in an endless belt shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-118135 filed on Jun. 15, 2017 and 2018-075088 filed on Apr. 9, 2018, which are hereby incorporated by reference herein in their entirety.

What is claimed is:

1. A charging roller for electrically charging a photosensitive member in contact with said photosensitive member, said charging roller comprising:

an outermost surface layer including an electroconductive resin material, first surface particles configured to form first projections at a surface of said charging roller, and second surface particles configured to form second projections at the surface of said charging roller, wherein said outermost surface layer satisfies conditions i) to v):

$$6.0\ (\mu m) \leq Rz \leq 18.8\ (\mu m), \quad \text{i}$$

where Rz is a ten-point average roughness (μm) of the surface of said charging roller, $$7\ (\mu m) \leq d \leq 20\ (\mu m), \quad \text{ii}$$

where d is a thickness (μm) of the outermost surface layer, $$9.8\ (\mu m) \leq D1 \leq 15.8\ (\mu m) \text{ and } 2.8\ (\mu m) \leq D2 \leq 5.2\ (\mu m), \quad \text{iii}$$

where D1 is an average particle size (μm) of said first surface particles, and D2 is an average particle size (μm) of said second surface particles, $$3.0 \leq D1/D2 \leq 5.6, \text{ and} \quad \text{iv}$$

$$0.10 \leq M1/(M1+M2) \leq 0.32, \quad \text{v}$$

where M1 is a total weight (mg) of said first surface particles per unit area of the surface of said charging roller, and M2 is a total weight (mg) of said second surface particles per unit area of the surface of said charging roller.

2. The charging roller according to claim 1, wherein said outermost surface layer satisfies conditions:

$$1.0(\%) \leq S1 \leq 3.9(\%) \text{ and}$$

$$13.5(\%) \leq S2 \leq 25.5(\%),$$

where S1 is a projection area ratio (%), of the projections by said first surface particles, per unit area of the surface of said charging roller, and S2 is a projection area ratio (%), of the projections by said second surface particles, per unit area of the surface of said charging roller.

3. The charging roller according to claim 1, wherein said first and second surface particles are formed of either one material selected from an urethane resin material, an urethane-acryl resin material, an acrylic resin material and an acryl-styrene copolymer.

4. A cartridge detachably mountable to a main assembly of an image forming apparatus, said cartridge comprising:

a photosensitive member;

a charging roller configured to electrically charge said photosensitive member in contact with said photosensitive member;

an outermost surface layer including an electroconductive resin material, first surface particles configured to form first projections on a surface of said charging roller, and second surface particles configured to form second projections on the surface of said charging roller, wherein said outermost surface layer satisfies conditions i) to v):

$$6.0\ (\mu m) \leq Rz \leq 18.8\ (\mu m), \quad \text{i}$$

where Rz is a ten-point average roughness (μm) of the surface of said charging roller, $$7\ (\mu m) \leq d \leq 20\ (\mu m), \quad \text{ii}$$

where d is a thickness (μm) of the outermost surface layer, $$9.8\ (\mu m) \leq D1 \leq 15.8\ (\mu m) \text{ and } 2.8\ (\mu m) \leq D2 \leq 5.2\ (\mu m), \quad \text{iii}$$

where D1 is an average particle size (μm) of said first surface particles, and D2 is an average particle size (μm) of said second surface particles, $$3.0 \leq D1/D2 \leq 5.6, \text{ and} \quad \text{iv}$$

$$0.10 \leq M1/(M1+M2) \leq 0.32, \quad \text{v}$$

where M1 is a total weight (mg) of said first surface particles per unit area of the surface of said charging roller, and M2 is a total weight (mg) of said second surface particles per unit area of the surface of said charging roller.

5. The cartridge according to claim 4, wherein said outermost surface layer satisfies conditions:

$$1.0(\%) \leq S1 \leq 3.9(\%) \text{ and}$$

$$13.5(\%) \leq S2 \leq 25.5(\%),$$

where S1 is a projection area ratio (%), of the projections by said first surface particles, per unit area of the surface of said charging roller, and S2 is a projection area ratio (%), of the projections by said second surface particles, per unit area of the surface of said charging roller.

6. The cartridge according to claim 4, wherein said first and second surface particles are formed of either one material selected from an urethane resin material, an urethane-acryl resin material, an acrylic resin material and an acryl-styrene copolymer.

7. The cartridge according to claim 4, wherein a surface of said photosensitive member has a value, obtained by dividing an elastic deformation work amount by an entire work amount, of 47% or more.

8. The cartridge according to claim 4, wherein at a surface of said photosensitive member, a plurality of independent recesses are formed.

9. The cartridge according to claim 4, wherein a voltage applied to said charging roller when said photosensitive member is electrically charged by said charging roller is only a DC voltage.

10. An image forming apparatus comprising:

a photosensitive member;

a charging roller configured to electrically charge a photosensitive member under application of a voltage, wherein said charging roller has an outermost surface layer including an electroconductive resin material, first surface particles configured to form first projections on a surface of said charging roller, and second surface particles configured to form second projections on the surface of said charging roller, wherein said outermost surface layer satisfies conditions i) to v):

$$6.0\ (\mu m) \leq Rz \leq 18.8\ (\mu m), \quad \text{i}$$

where Rz is a ten-point average roughness (μm) of the surface of said charging roller, $$7\ (\mu m) \leq d \leq 20\ (\mu m), \quad \text{ii}$$

where d is a thickness (μm) of the outermost surface layer, $$9.8\ (\mu m) \leq D1 \leq 15.8\ (\mu m) \text{ and } 2.8\ (\mu m) \leq D2 \leq 5.2\ (\mu m), \quad \text{iii}$$

where D1 is an average particle size (μm) of said first surface particles, and D2 is an average particle size (μm) of said second surface particles, $$3.0 \leq D1/D2 \leq 5.6, \text{ and} \quad \text{iv}$$

$$0.10 \leq M1/(M1+M2) \leq 0.32, \quad \text{v}$$

where M1 is a total weight (mg) of said first surface particles per unit area of the surface of said charging roller, and M2 is a total weight (mg) of said second surface particles per unit area of the surface of said charging roller; and an image forming portion configured to form a toner image on said photosensitive member charged by said charging roller and then to transfer the toner image onto a recording material.

11. The image forming apparatus according to claim 10, wherein said outermost surface layer satisfies conditions:

$$1.0(\%) \leq S1 \leq 3.9(\%) \text{ and}$$

$$13.5(\%) \leq S2 \leq 25.5(\%),$$

where S1 is a projection area ratio (%), of the projections by said first surface particles, per unit area of the surface of said charging roller, and S2 is a projection area ratio (%), of the projections by said second surface particles, per unit area of the surface of said charging roller.

12. The image forming apparatus according to claim 10, wherein said first and second surface particles are formed of either one material selected from an urethane resin material, an urethane-acryl resin material, an acrylic resin material and an acryl-styrene copolymer.

13. The image forming apparatus according to claim 10, wherein a surface of said photosensitive member has a value, obtained by dividing an elastic deformation work amount by an entire work amount, of 47% or more.

14. The image forming apparatus according to claim 10, wherein at a surface of said photosensitive member, a plurality of independent recesses are formed.

15. The image forming apparatus according to claim 10, wherein a voltage applied to said charging roller when said photosensitive member is electrically charged by said charging roller is only a DC voltage.

16. A manufacturing method of a charging roller, including an electroconductive rotation shaft, a base layer formed outside the electroconductive rotation shaft, and a surface layer formed outside the base layer, for electrically charging a photosensitive member in contact with the photosensitive member under application of a voltage, said manufacturing method comprising:

a first step of forming the base layer outside the electroconductive rotation shaft;

a second step of preparing a surface layer paint by mixing first and second surface particles in a curable resin solution so as to satisfy conditions:

$$9.8\ (\mu m) \leq D1 \leq 15.8\ (\mu m),$$

$$2.9\ (\mu m) \leq D2 \leq 5.2\ (\mu m),$$

$$3.0\ (\mu m) \leq D1/D2 \leq 5.6, \text{ and}$$

$$0.1 \leq M1/(M1+M2) \leq 0.32,$$

where D1 is an average particle size (μm) of the first surface particles, D2 is an average particle size (μm) of the second surface particles, M1 is a total weight (mg) of the first surface particles per unit area of the surface layer paint and M2 is a total weight (mg) of the second surface particles per unit area of the surface layer paint;

a third step of forming a coating of the surface layer paint on the base layer; and a fourth step of forming the surface layer by curing the coating, wherein the surface layer formed in said fourth step satisfies the following conditions:

$$6.0\ (\mu m) \leq Rz \leq 18.8\ (\mu m), \text{ and}$$

$$7\ (\mu m) \leq d \leq 20\ (\mu m),$$

where Rz is a ten-point average roughness (μm) of a surface of the charging roller, and d is a thickness (μm) of the surface layer.

17. The manufacturing method according to claim 16, wherein the surface layer formed in said fourth step satisfies conditions:

$$1.0(\%) \leq S1 \leq 3.9(\%) \text{ and}$$

$$13.5(\%) \leq S2 \leq 25.5(\%),$$

where S1 is a projection area ratio (%), of projections formed by the first surface particles, per unit area of the surface of the charging roller, and S2 is a projection area ratio (%), of projections formed by the second surface particles, per unit area of the surface of the charging roller.

18. The manufacturing method according to claim 16, wherein the first and second surface particles mixed in said second step are formed of either one material selected from an urethane resin material, an urethane-acryl resin material, an acrylic resin material and an acryl-styrene copolymer.

* * * * *